US005889242A

United States Patent [19]

Ishihara et al.

[11] Patent Number: 5,889,242

[45] Date of Patent: Mar. 30, 1999

[54] MULTIDIRECTIONAL OPERATING SWITCH AND MULTIDIRECTIONAL OPERATING APPARATUS USING THE SAME

[75] Inventors: Yukihiro Ishihara, Kaizuka; Keiji Kaizaki, Tsuyama; Hiroshi Matsui, Hirakata, all of Japan

[73] Assignee: Matsushita Electric Industrial Co., Ltd., Kadoma, Japan

[21] Appl. No.: 949,233

[22] Filed: Oct. 13, 1997

[30] Foreign Application Priority Data

| | | | |
|---|---|---|---|
| Oct. 17, 1996 | [JP] | Japan | 8-274419 |
| May 14, 1997 | [JP] | Japan | 9-123700 |
| Jul. 25, 1997 | [JP] | Japan | 9-199622 |

[51] Int. Cl.[6] ..... H01H 25/06

[52] U.S. Cl. ..... 200/6 A

[58] Field of Search ..... 200/4, 5 R, 6 R, 200/6 A, 16 R, 17 R, 18, 332, 335, 339

[56] References Cited

U.S. PATENT DOCUMENTS

| | | | |
|---|---|---|---|
| 2,808,476 | 10/1957 | Elliott | 200/6 |
| 2,849,549 | 8/1958 | Elliott | 200/6 |
| 4,394,548 | 7/1983 | Dola | 200/6 A |
| 4,428,649 | 1/1984 | Main et al. | 350/289 |
| 4,486,629 | 12/1984 | Sledesky | 200/6 A |
| 4,501,939 | 2/1985 | Hyltin et al. | 200/6 A |
| 4,614,847 | 9/1986 | Sasao | 200/6 |
| 4,687,200 | 8/1987 | Shirai | 273/148 |
| 4,947,461 | 8/1990 | Yoshioka et al. | 200/5 |
| 5,268,542 | 12/1993 | Voll | 200/5 |
| 5,378,862 | 1/1995 | Tasaka et al. | 200/6 |

*Primary Examiner*—Michael A. Friedhofer

*Attorney, Agent, or Firm*—Renner, Otto, Boisselle & Sklar, P.L.L.

[57] ABSTRACT

A multidirectional switch, which performs a tilting operation in multiple directions generating a signal by tilting the shaft portion of the operating member, includes: a dome-shaped movable contact made of a resilient thin metal plate; a box-shaped case; a cover including a through hole at a center thereof, the cover covers an upper opening of the case; and a flange portion integrally formed at a lower end of the shaft portion of the operating member. The case includes, on a bottom surface thereof: an outer fixed contact on which an outer peripheral lower end portion of the dome-shaped movable contact is placed; and a plurality of inner fixed contacts provided inside positions corresponding to the outer peripheral lower end portion of the dome-shaped movable contact so as to be equiangular and equidistant from a center of the dome-shaped movable contact. In the operating member, the shaft portion extends upwards out of the through hole of the cover, an upper surface of the flange portion is in contact with an inner surface of the cover, a periphery of the operating member is fitted and supported by an inner wall of the case so that the operating member is not rotatable but is tiltable and movable vertically, first pressing portions are provided respectively at positions on a lower surface of the operating member corresponding to the plurality of inner fixed contacts, and the plurality of first pressing portions are in contact with the dome-shaped movable contact.

28 Claims, 19 Drawing Sheets

MULTIDIRECTIONAL OPERATING SWITCH AND MULTIDIRECTIONAL OPERATING APPARATUS USING THE SAME

BACKGROUND OF THE INVENTION

1. Field of the Invention

The present invention relates to a multidirectional operating switch which is driven by tilting or pushing an operating shaft and is used as an input operation section in mobile communication apparatuses such as a portable telephone, a pager, etc., or various electronic apparatuses such as a remote control apparatus, an audio apparatus, a TV game apparatus, a car navigation system, an electronic camera, etc., and also relates to a multidirectional operating apparatus using the same.

2. Description of the Related Art

A conventional multidirectional operating switch will be described with reference to FIGS. 1 to 4.

FIG. 1 is a cross-sectional view illustrating a configuration of the conventional multidirectional operating switch; and FIG. 2 is a partially cutaway exploded perspective view illustrating the same.

The illustrated multidirectional operating switch has a box-shaped case 1 made of a resin, with an opening thereof being covered by a cover 2 made of a metal plate, or the like. As shown in FIG. 2, central fixed contacts 3A and 3B (also indicated generically by reference numeral 3) and four peripheral fixed contacts 4 to 7 are fixed by the insert molding on the bottom surface of the case 1. The peripheral fixed contacts 4 to 7 are provided along the periphery around the center of the location of the central fixed contact 3 so as to be equally spaced apart from one another. The fixed contacts 3 to 7 are connected respectively to terminals 14 to 18 for connection to an external circuit.

A dome-shaped movable contact 8 is placed on the outer contacts 3A of the central fixed contact 3. On the other hand, resilient contact members 10 to 13 of a common movable contact member 9, which is secured by dowels 1A, are placed on the peripheral fixed contacts 4 to 7, respectively. The resilient contact members 10 to 13 are connected via a contact 19 to a terminal 19A for connection to an external circuit.

Compression coil springs 20 are arranged along the inner periphery of the wall of the case 1. The compression coil spring 20 biases a supporting member 21 upwards so that an upper end portion 21A thereof elastically contacts the lower surface of the cover 2.

A dent portion 21B is provided at the center of the supporting member 21, so as to hold a hemisphere rotation member 22. A flange portion 22A around the lower periphery of the rotation member 22 is placed on the bottom surface of the dent portion 21B provided at the center of the supporting member 21. An upper spherical surface portion 22B is in contact with a spherical circular hole 2A of the cover 2 so as to fit therein. Moreover, a rod-like operating shaft 23 made of a metallic material is fitted and held in a non-circular central vertical hole 22C of the rotation member 22 so that it can move vertically.

A lower end portion 23A of the operating shaft 23 extends downwards past the rotation member so as to be in contact with the dome-shaped movable contact 8 provided at the center of the bottom surface of the case 1. On the other hand, an operating knob 24 is attached to a tip portion 23B of the operating shaft 23 which extends upwards out of the case 1.

Moreover, pressing portions 25A to 25D are provided on the peripheral portion of the lower surface of the supporting member 21 so as to correspond respectively to the resilient contact members 10 to 13 of the common movable contact member 9.

Hereinafter, the operation of the conventional multidirectional operating switch having such a configuration will be described further referring to FIGS. 3 and 4 as well as FIG. 1. Each of FIGS. 3 and 4 is a cross-sectional view schematically illustrating a certain operation state of the conventional multidirectional operating switch.

In the state shown in FIG. 1, the operating shaft 23 is in the vertical and neutral position, with the lower end portion 23A thereof not pressing down the dome-shaped movable contact 8. In this state, connection between any pair of the contacts is in the OFF state.

When an end of the knob 24 (the left end in the example illustrated in FIG. 3) is pressed down as indicated by an arrow in FIG. 3, the operating shaft 23 is tilted, and the rotation member 22 rotates to the left while being in contact with the spherical circular hole 2A of the cover 2. Thus, the end portion of the flange portion 22A on the lower surface of the rotation member 22 presses down the bottom surface of the dent portion 21B of the supporting member 21, and the supporting member 21 is tilted to the left about a fulcrum at the upper end portion 21A on the side of the square opposite to the side of the pressed surface. Thus, the resilient contact member 10, which corresponds to the pressing portion 25A, is pressed down so as to contact the corresponding peripheral fixed contact 4. This turns ON the connection between the common movable contact member 9 and the peripheral fixed contact 4 so as to supply a signal to the outside through the terminals 19A and 15.

At this point, a portion of the peripheral upper end portion 21A of the supporting member 21 which is located on the left in FIG. 3 comes off the lower surface of the cover 2 while compressing downwards the compression coil spring 20. Thereafter, when the force being applied to the knob 24 is removed, the supporting member 21 and the rotation member 22 are pushed back to the original neutral position by virtue of the restoring force of the compression coil spring 20. Moreover, the resilient contact member 10 comes off the peripheral fixed contact 4 and back to the original position (see FIG. 1) by virtue of the resilient restoring force thereof, whereby the switch contact is turned back to the OFF state.

As described above, by pressing down the upper surface of the knob 24 at a certain point thereof, a signal is supplied from the switch to the outside through one of the terminals 16 to 18 which corresponds to the pressed position (direction).

Moreover, when the operating shaft 23 is pressed down by vertically pressing down the central portion of the upper surface of the knob 24, i.e., the operating shaft 23, as indicated by an arrow in FIG. 4, the lower end portion 23A of the operating shaft 23 presses down the dome-shaped movable contact 8. This inverts the dome-shaped movable contact 8, thereby generating a click while turning ON the connection between the central fixed contact 3 (between 3A and 3B), and a signal is generated and supplied to the outside through the terminal 14.

When the force being applied to the knob 24 is removed, the operating shaft 23 is pushed up by virtue of the restoring force of the dome-shaped movable contact 8 so as to be back in the original position as shown in FIG. 22.

However, while there has been a strong demand for downsizing various electronic apparatuses, the conventional multidirectional operating switch having such a configuration is too large in terms of outer diameter and thickness, and will not satisfy such a downsizing demand. Moreover, the number of components is large, and the cost is high.

Furthermore, a click is not generated when a switching operation is performed by tilting the operating shaft 23, whereby the switching operation cannot be ensured by a feel.

SUMMARY OF THE INVENTION

A multidirectional operating switch according to the present invention includes: a dome-shaped movable contact made of a resilient thin metal plate; a box-shaped case including, on a bottom surface thereof, an outer fixed contact on which an outer peripheral lower end portion of the dome-shaped movable contact is placed, and a plurality of inner fixed contacts provided inside positions corresponding to the outer peripheral lower end portion of the dome-shaped movable contact so as to be equiangular and equidistant from a center of the dome-shaped movable contact; a cover including a through hole at a center thereof, the cover being provided so as to cover an upper opening of the case; and an operating member including a shaft portion and a flange portion integrally formed at a lower end of the shaft portion, in which the shaft portion extends upwards out of the through hole of the cover, an upper surface of the flange portion is in contact with an inner surface of the cover, a periphery of the operating member is fitted and supported by an inner wall of the case so that the operating member is not rotatable but is tiltable and movable vertically, first pressing portions are provided respectively at positions on a lower surface of the operating member corresponding to the plurality of inner fixed contacts, and the plurality of first pressing portions are in contact with the dome-shaped movable contact. The switch performs a tilting operation in multiple directions so as to generate a signal by tilting the shaft portion of the operating member.

Specifically, a click is generated in the tilting operation of the operating member.

In one embodiment, the case further includes a central fixed contact provided at a position on a bottom surface of the case which corresponds to the center of the dome-shaped movable contact; and the operating member further includes a second pressing portion provided at a position on the lower surface of the operating member which corresponds to the center of the dome-shaped movable contact.

Preferably, a height of each of the plurality of first pressing portions is less than a height of the second pressing portion.

In another embodiment, a hole is provided at the center of the dome-shaped movable contact; the central fixed contact has a diameter smaller than the diameter of the hole of the dome-shaped movable contact; and the height of each of the plurality of inner fixed contacts is less than the height of the central fixed contact.

The first pressing portion may be a polygonal ring-shaped pressing portion or a circular ring-shaped pressing portion which includes, at the center thereof, a dent portion larger than the hole of the dome-shaped movable contact; and the second pressing portion may be formed, in the dent portion of the first pressing portion, of a conductive member approximately as tall as the first pressing portion.

In still another embodiment, a hole is provided at the center of the dome-shaped movable contact; the case further includes a central bump portion provided at a position on a bottom surface of the case which corresponds to the center of the dome-shaped movable contact, the central bump portion having a diameter smaller than the diameter of the hole of the dome-shaped movable contact and extending taller than the outer fixed contact; and the operating member further includes a dent portion provided at the center of the lower surface of the operating member so as to engage with the central bump portion of the case.

The first pressing portion may be a polygonal ring-shaped pressing portion or a circular ring-shaped pressing portion which includes, at the center thereof, a dent portion larger than the hole of the dome-shaped movable contact.

In one embodiment, the plurality of first pressing portions are each formed of a resilient member.

In another embodiment, the second pressing portion is formed of a resilient conductive member.

In still another embodiment, the plurality of first pressing portions and the second pressing portion are integrally formed of a conductive member.

In still another embodiment, the switch further includes a conductive resilient member provided between the outer fixed contact and the dome-shaped movable contact, the conductive resilient member having a repulsive force smaller than an inversion force of the dome-shaped movable contact.

In still another embodiment, the switch further includes a resilient member provided between the inner surface of the cover and the upper surface of the flange of the operating member.

In still another embodiment, the dome-shaped movable contact includes an outer peripheral portion in a frustum shape and a portion inside the outer peripheral portion in a substantially spherical shape with a central portion thereof being raised slightly, and the frustum shape and the substantially spherical shape are connected to each other at a boundary therebetween by a smooth curve.

Preferably, the dome-shaped movable contact is formed by a drawing process of a resilient metal thin plate.

Preferably, the angle formed between the slope of the frustum shape of the dome-shaped movable contact and the bottom surface thereof is about 25° to about 35°; the ratio of the height of the frustum shape of the dome-shaped movable contact with respect to the total height of the dome-shaped movable contact is about 70% to about 95%; and the ratio of the diameter of the first pressing portion of the operating member with respect to the outer diameter of the dome-shaped movable contact is about 40% to about 60%.

In still another embodiment, the operating member includes a hole running down from an upper end surface of the shaft portion; an operating knob having a leg portion which is coupled to the operating member by inserting the leg portion into the hole of the operating member; and the depth of the hole is greater than a distance by which the shaft portion extends out of the cover.

In still another embodiment, a dent portion or a protruding portion is provided on an inner wall surface of the hole of the operating member; a protruding portion or a dent portion is provided on an outer peripheral surface of the leg portion of the operating knob so as to engage with the dent portion or the protruding portion of the operating member.

Preferably, each of the hole of the operating member and the leg portion of the operating knob has a diameter at an upper portion thereof larger than a diameter at a lower portion thereof.

According to another aspect of the present invention, a multidirectional operating apparatus including a multidirectional operating switch as described above is provided. At least diagonally-located two of the plurality of inner fixed contacts are both turned ON when the shaft portion of the operating member of the multidirectional operating switch is pushed down vertically; and the apparatus comprises a processing section which processes a signal which is generated when two of the plurality of inner fixed contacts are both turned ON as a signal different from a signal which is generated when only one of the inner fixed contacts is turned ON.

In one embodiment, when the shaft portion of the operating member of the multidirectional operating switch is tilted toward a direction between adjoining two of the plurality of inner fixed contacts, the adjoining two of the inner fixed contacts are both turned ON; and the processing section processes a signal which is generated when the adjoining two of the inner fixed contacts are both turned ON as a signal different from the signal which is generated when only one of the inner fixed contacts is turned ON.

A multidirectional operating apparatus, provided in accordance with another aspect of the present invention, includes a multidirectional operating switch as described above. When the shaft portion of the operating member of the multidirectional operating switch is tilted toward a direction between adjoining two of the plurality of inner fixed contacts, the adjoining two of the inner fixed contacts are both turned ON; and the apparatus comprises a processing section which processes a signal which is generated when the adjoining two of the inner fixed contacts are both turned ON as a signal different from the signal which is generated when only one of the inner fixed contacts is turned ON.

In one embodiment, the case further includes a central fixed contact provided at a position on the bottom surface of the case which corresponds to the center of the dome-shaped movable contact; and the operating member further includes a second pressing portion provided at a position on a lower surface of the operating member which corresponds to the center of the dome-shaped movable contact.

In another embodiment, the apparatus detects a signal generated in the tilting operation of the shaft portion of the operating member of the multidirectional operating switch, and selects an item from a plurality of displayed items; and the apparatus detects a signal generated in a push operation of the shaft portion, and confirms the selection of the item.

In still another embodiment, the apparatus detects a signal generated in the tilting operation of the shaft portion of the operating member of the multidirectional operating switch, selects a pre-assigned vector direction signal of a plurality of vector signals, and moves a displayed object in the selected vector direction; and the apparatus detects a signal generated in a push operation of the shaft portion, and executes a pre-assigned instruction for the moved object.

In still another embodiment, the apparatus detects a signal generated by performing a plurality of push operations of the shaft portion of the operating member of the multidirectional operating switch within a predetermined period of time, and sequentially executes a plurality of instruction signals which are predesigned for the detected signals.

In still another embodiment, the apparatus detects a signal generated in a push operation of the shaft-portion of the operating member of the multidirectional operating switch, and based on the detected signal, alters instructions which are respectively assigned for tilting directions of the shaft portion in the tilting operation of the shaft portion, in accordance with a predetermined order.

In still another embodiment, an up-down adjustment of functions assigned to the tilting directions is performed by tilting the shaft portion toward a predetermined tilting direction during the tilting operation of the shaft portion of the operating member of the multidirectional operating switch.

Thus, the invention described herein makes possible the advantages of: (1) providing a multidirectional operating switch with which it is possible to reliably perform a switching operation while ensuring the switching operation by a click even when a switching operation is performed by tilting the operating shaft, and which requires a small number of components and a low cost; and (2) providing a multidirectional operating apparatus using the same.

These and other advantages of the present invention will become apparent to those skilled in the art upon reading and understanding the following detailed description with reference to the accompanying figures.

Figure 1:
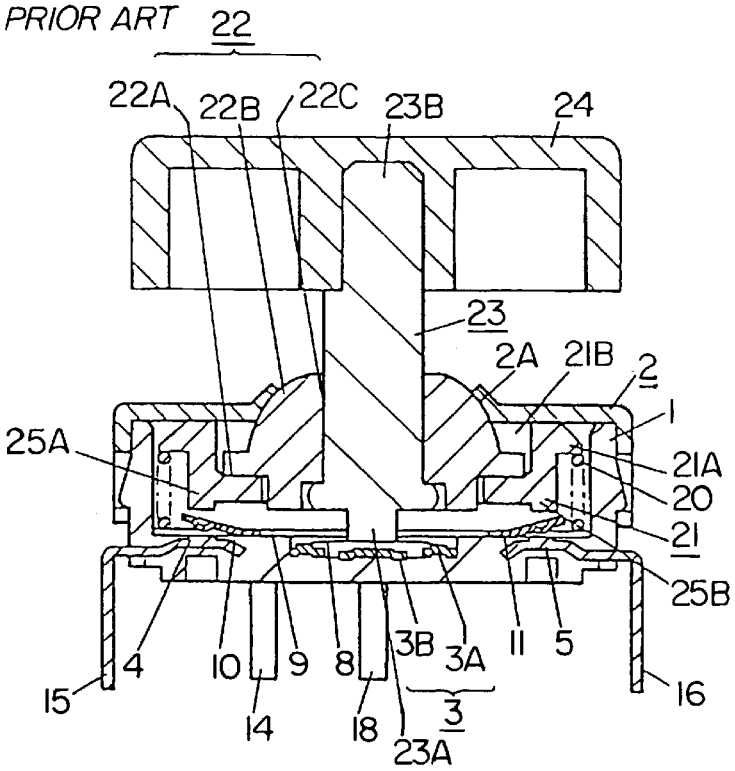
FIG. 1 PRIOR ART
FIG. 1 is a cross-sectional view illustrating a configuration of a conventional multidirectional operating switch.
Figure 2:
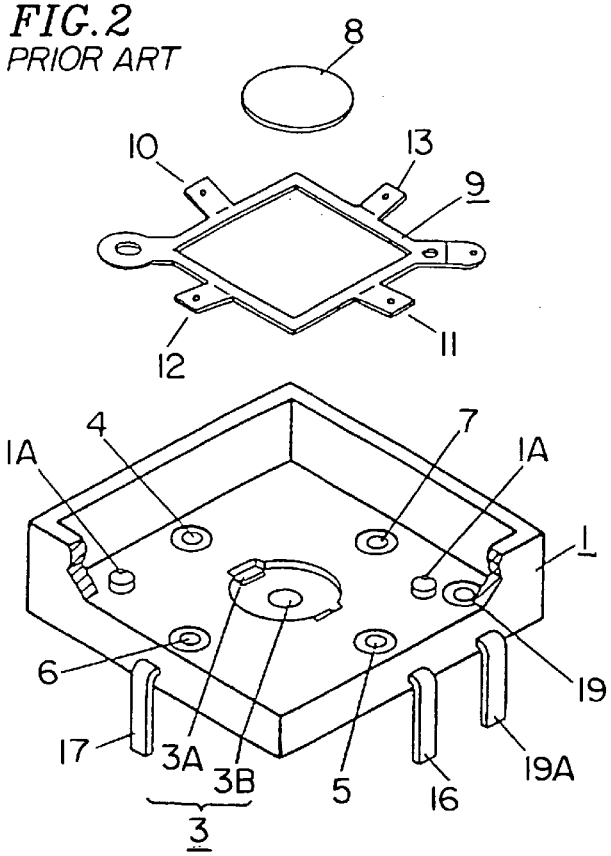
FIG. 2 PRIOR ART
FIG. 2 is a partially cutaway exploded perspective view illustrating the multidirectional operating switch of FIG. 1.
Figure 3:
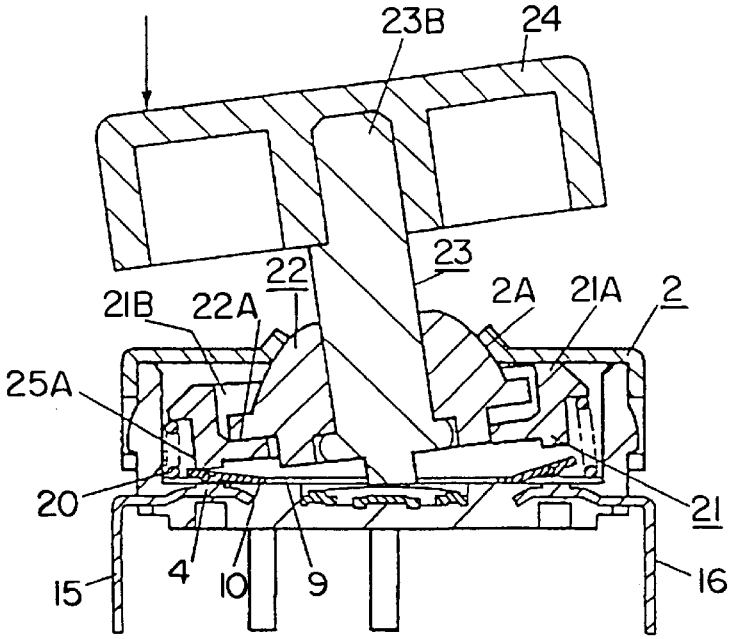
FIG. 3 PRIOR ART
Figure 4:
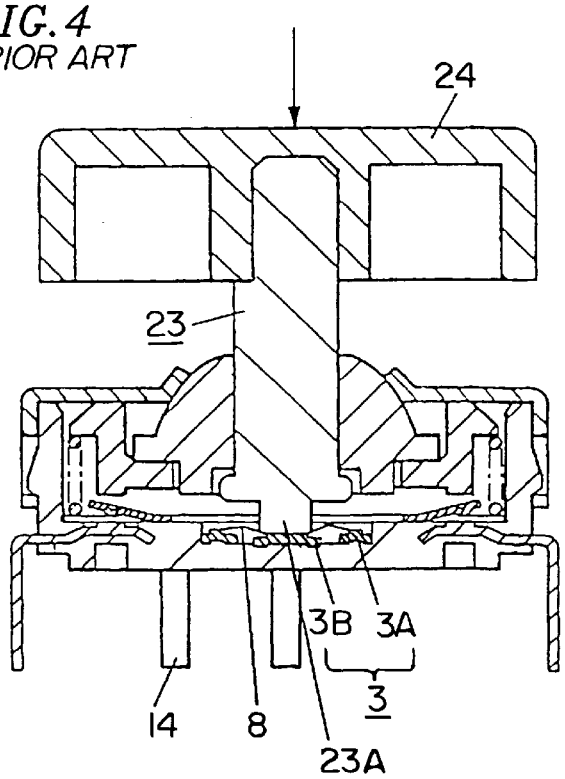
FIG. 4 PRIOR ART

Each of FIGS. 3 and 4 is a cross-sectional view schematically illustrating a certain operation state of the conventional multidirectional operating switch.

Figure 5:
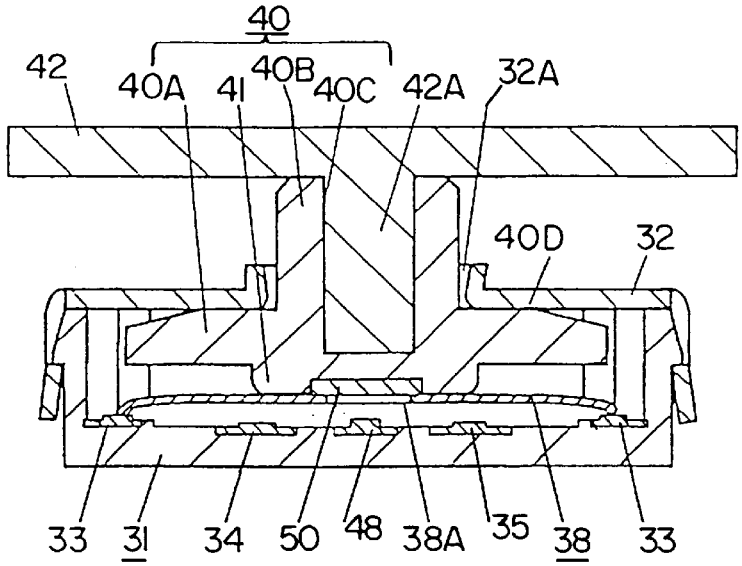

FIG. 5 is a cross-sectional view illustrating a configuration of a multidirectional operating switch according to Example 1 of the present invention.

Figure 6A:
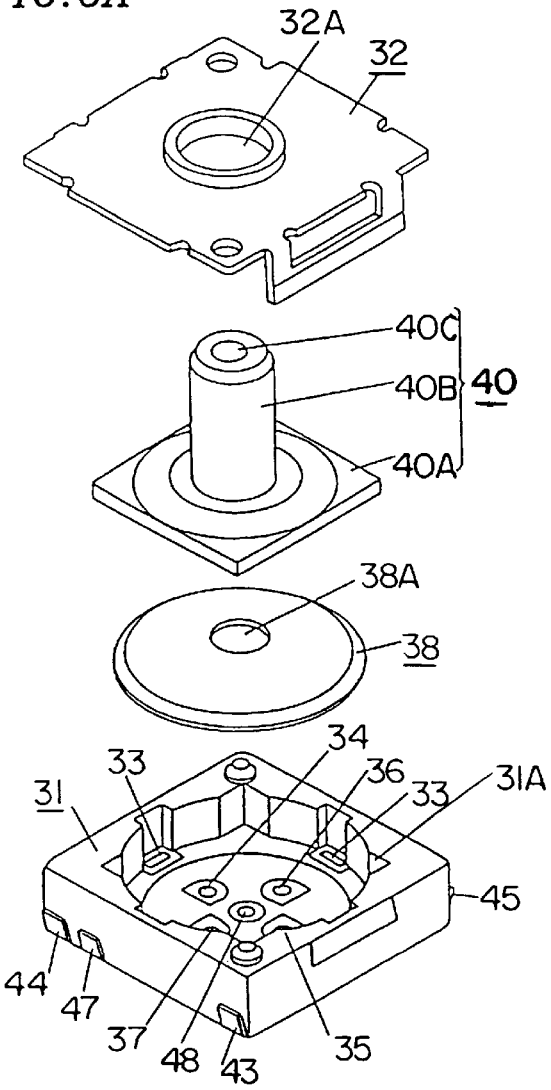

FIG. 6A is an exploded perspective view illustrating the multidirectional operating switch of FIG. 5.

Figure 6B:
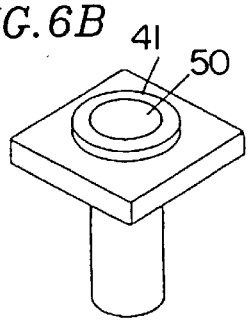

FIG. 6B is a perspective view illustrating an operating member which is the main component in the configuration of the multidirectional operating switch of FIG. 5.

Figure 7:
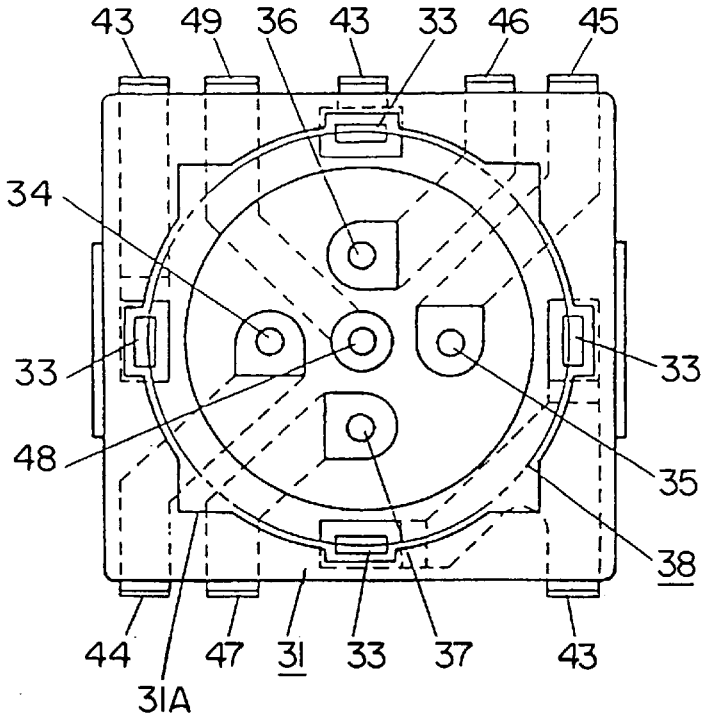

FIG. 7 is a plan view illustrating the multidirectional operating switch of FIG. 5.

Figure 8A:
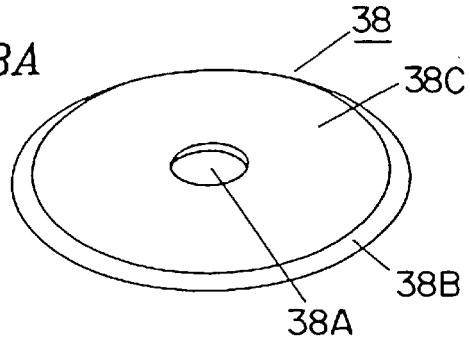
Figure 8B:
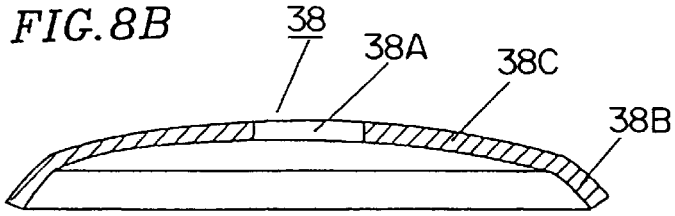

FIGS. 8A and 8B are a perspective view and a cross-sectional view, respectively, illustrating a dome-shaped movable contact included in the multidirectional operating switch of FIG. 5.

Figure 9:
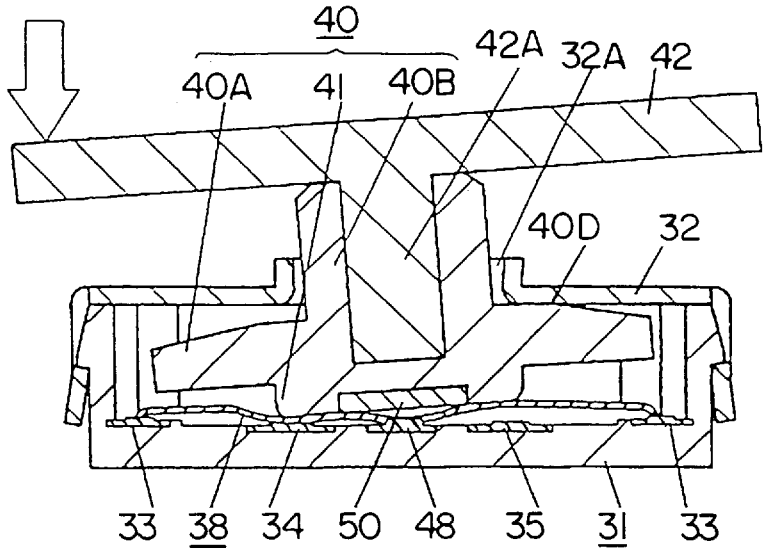
Figure 10:
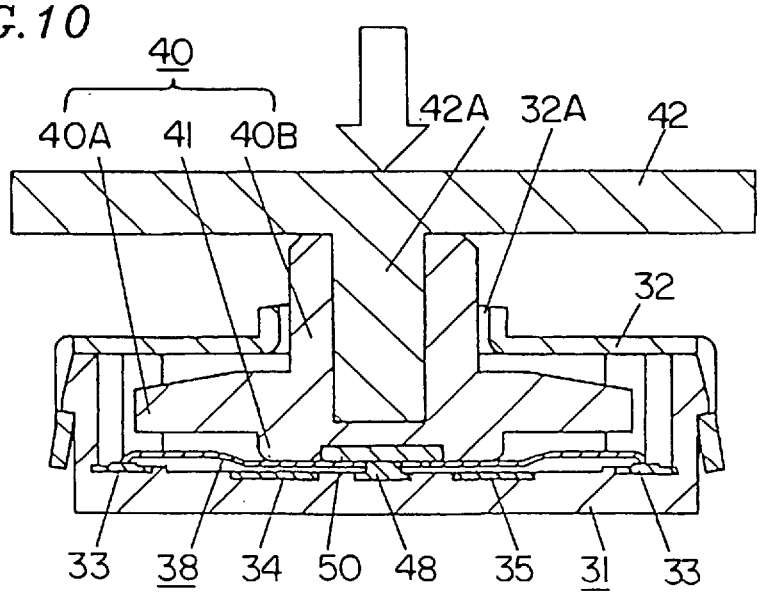

Each of FIGS. 9 and 10 is a cross-sectional view schematically illustrating a certain operation state of the multidirectional operating switch of FIG. 5.

Figure 11:
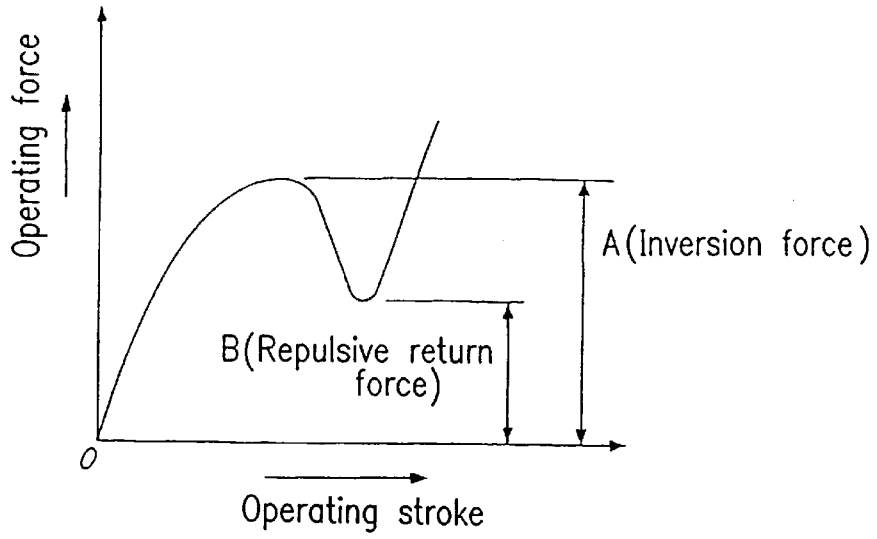

FIG. 11 is a characteristic diagram showing variation in the operating force with respect to the operating stroke when pressing down the dome-shaped movable contact.

Figure 12A:
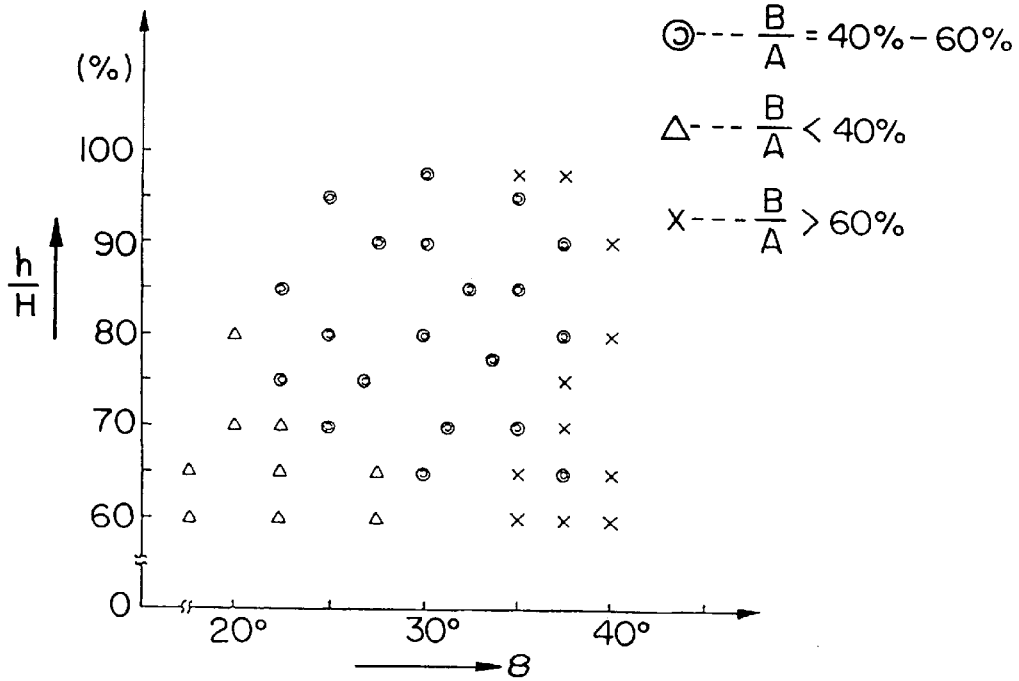

FIG. 12A is a graph showing the results of a study for the shape of the dome-shaped movable contact included in the multidirectional operating switch of FIG. 5 which meets a preferable operating feeling.

Figure 12B:
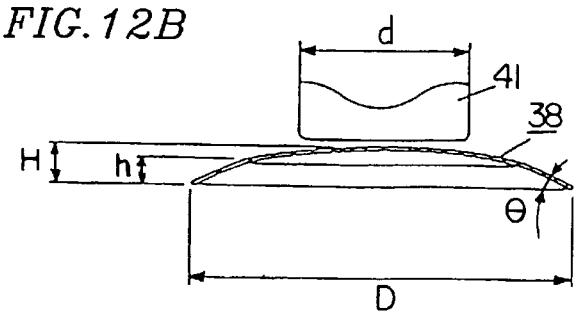

FIG. 12B is a partial cross-sectional view schematically illustrating the dome-shaped movable contact and the inner pressing portions included in the multidirectional operating switch of FIG. 5.

Figure 13:
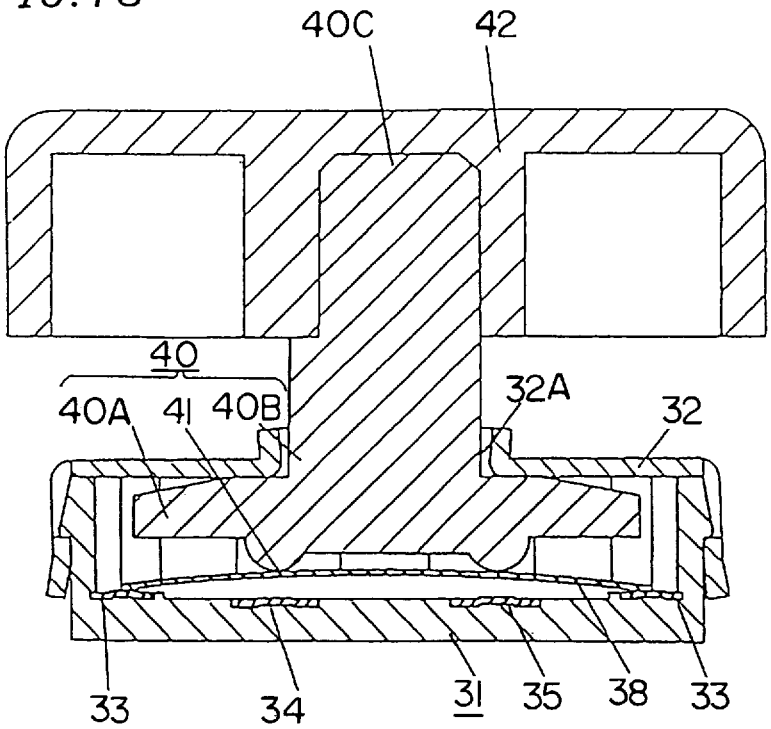

FIG. 13 is a cross-sectional view illustrating a configuration of a multidirectional operating switch according to Example 3 of the present invention.

Figure 14:
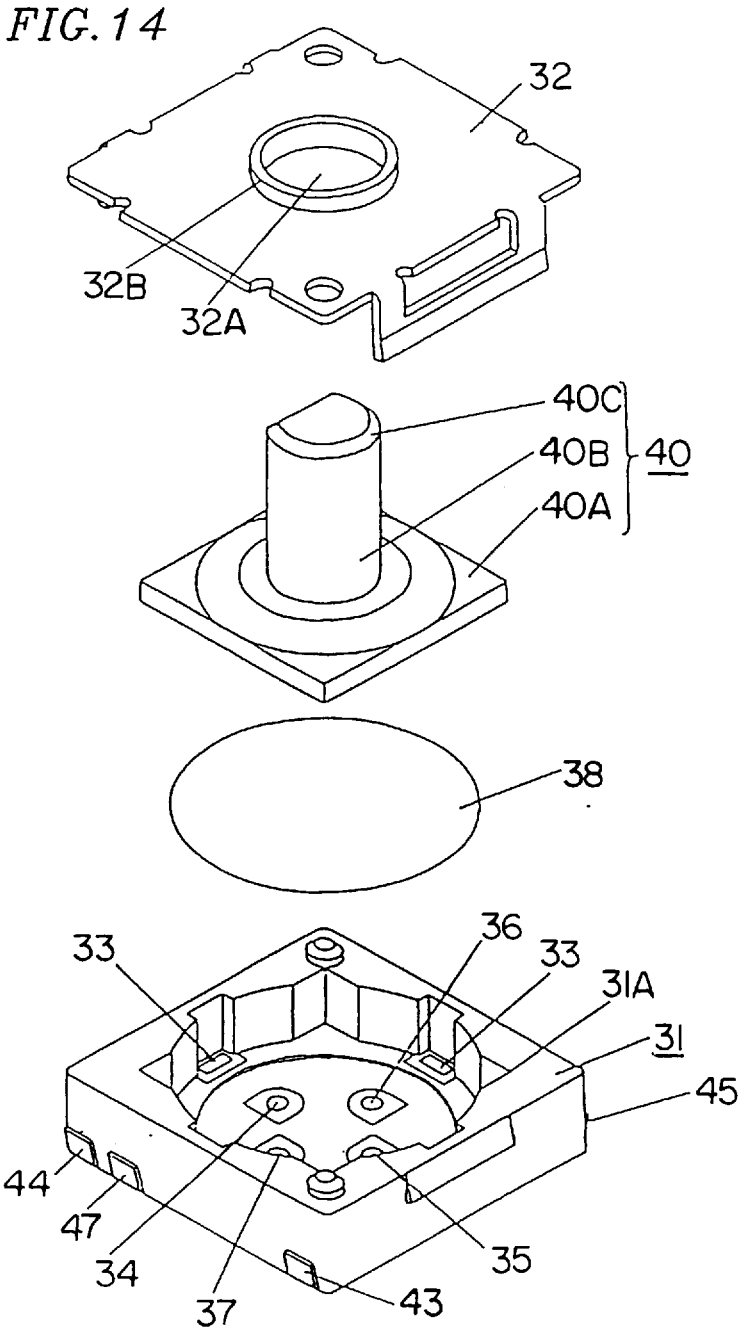

FIG. 14 is an exploded perspective view illustrating the multidirectional operating switch of FIG. 13.

Figure 15:
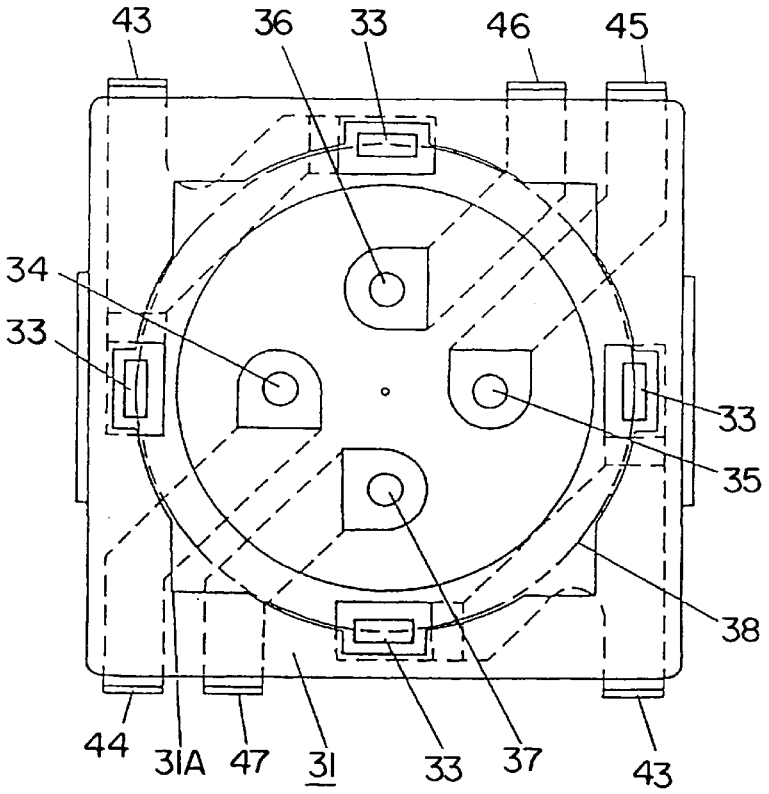

FIG. 15 is a plan view illustrating the multidirectional operating switch of FIG. 13.

Figure 16A:
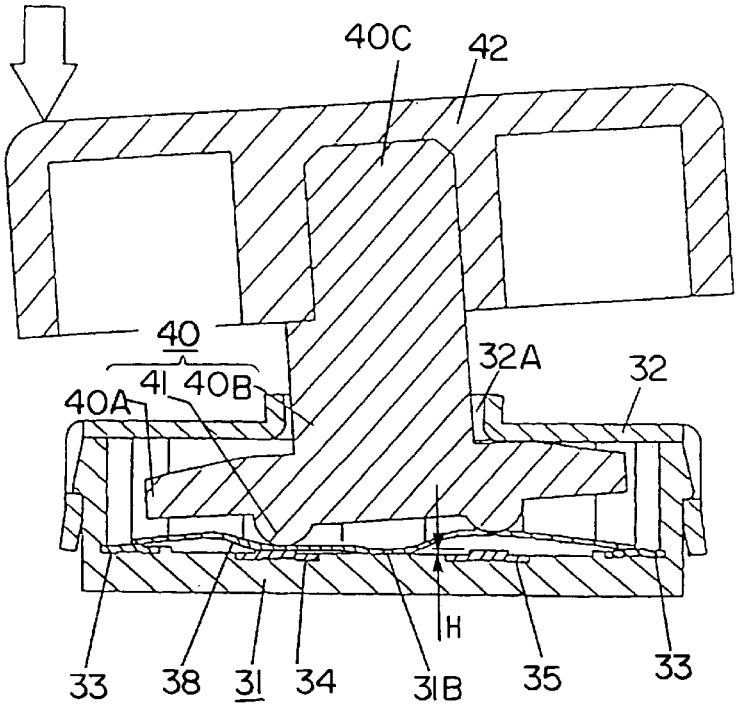
Figure 16B:
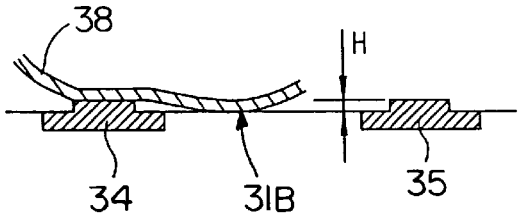

FIG. 16A is a cross-sectional view schematically illustrating a certain operation state of the multidirectional operating switch of FIG. 13, and FIG. 16B is a partially expanded view of FIG. 16A.

Figure 17A:
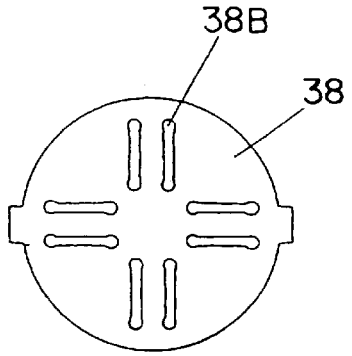
Figure 17B:
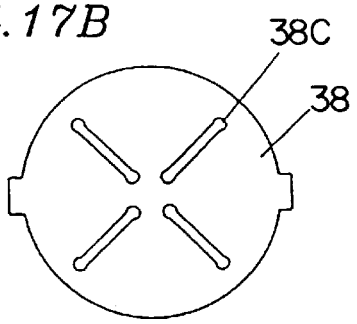

Each of FIGS. 17A and 17B is a plan view schematically illustrating an exemplary shape of the dome-shaped movable contact included in the multidirectional operating switch of FIG. 13.

Figure 18:
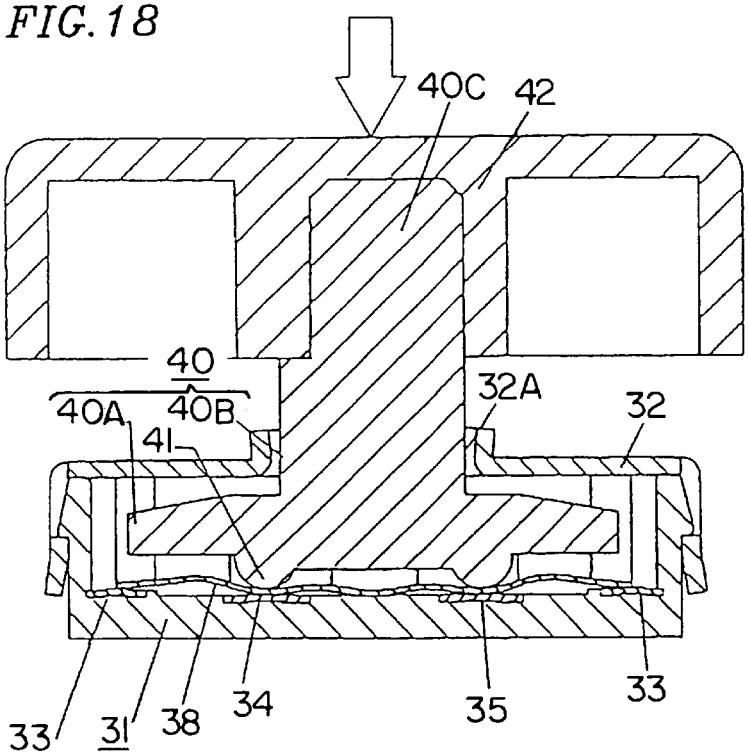

FIG. 18 is a cross-sectional view schematically illustrating a certain operation state of the multidirectional operating switch of FIG. 13.

Figure 19:
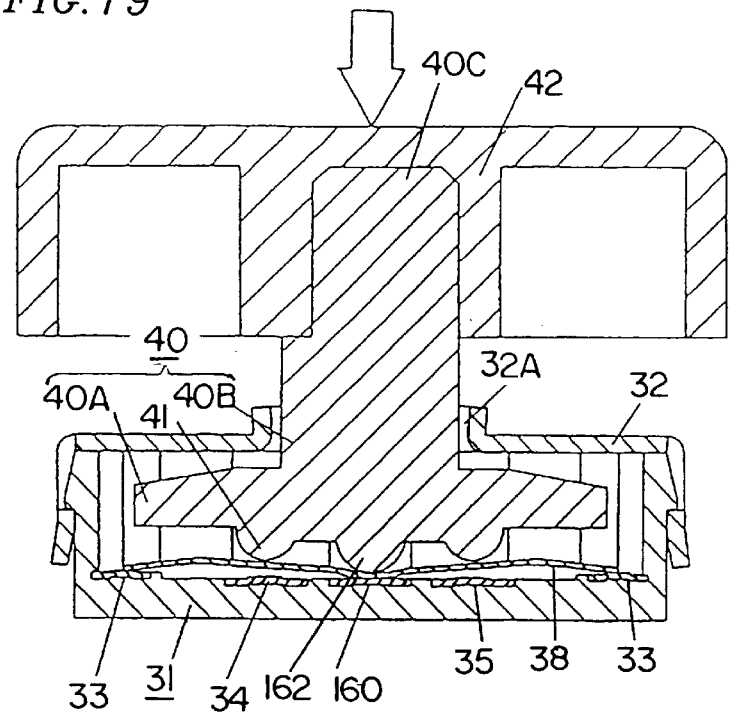

FIG. 19 is a cross-sectional view illustrating a multidirectional operating switch according to Example 4 of the present invention.

Figure 20:
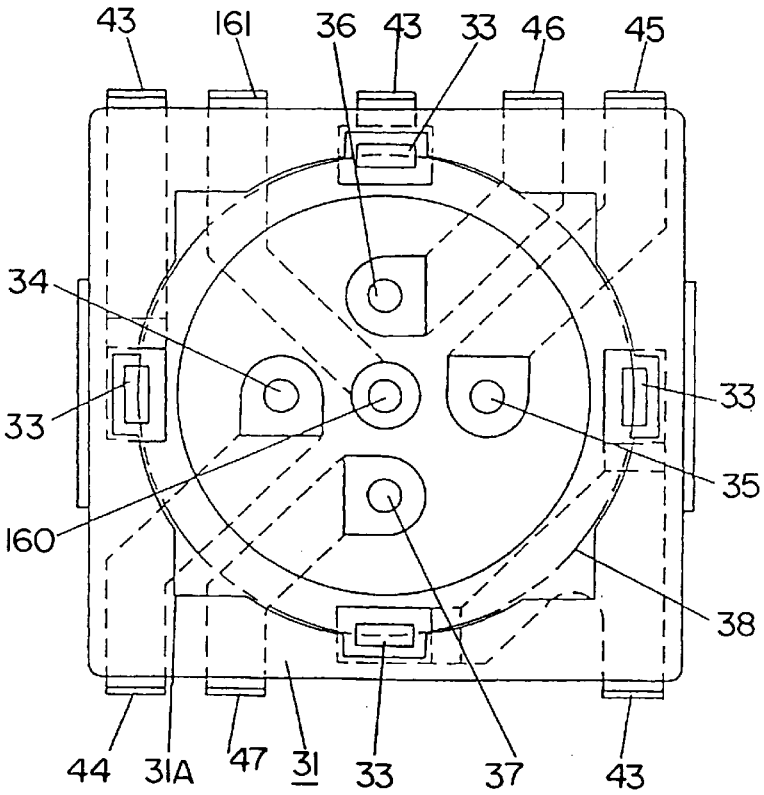

FIG. 20 is a plan view illustrating the multidirectional operating switch of FIG. 19.

Figure 21:
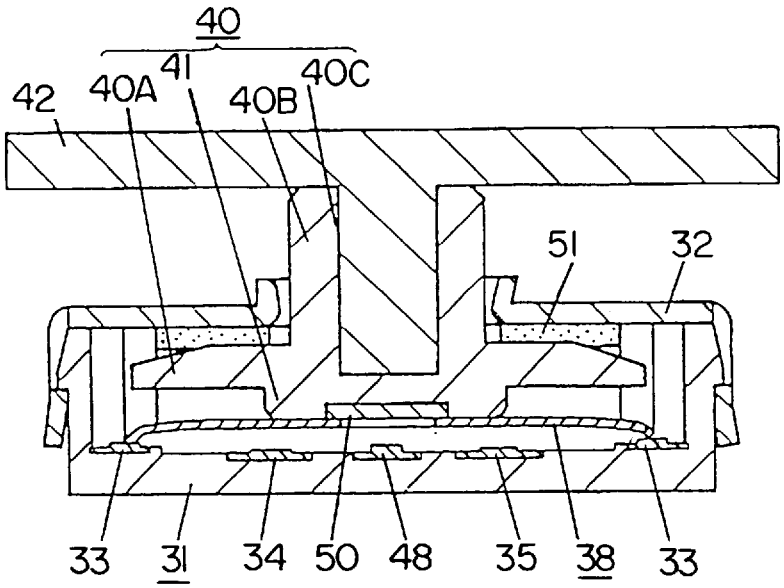

FIG. 21 is a cross-sectional view illustrating a configuration of a multidirectional operating switch according to Example 5 of the present invention.

Figure 22:
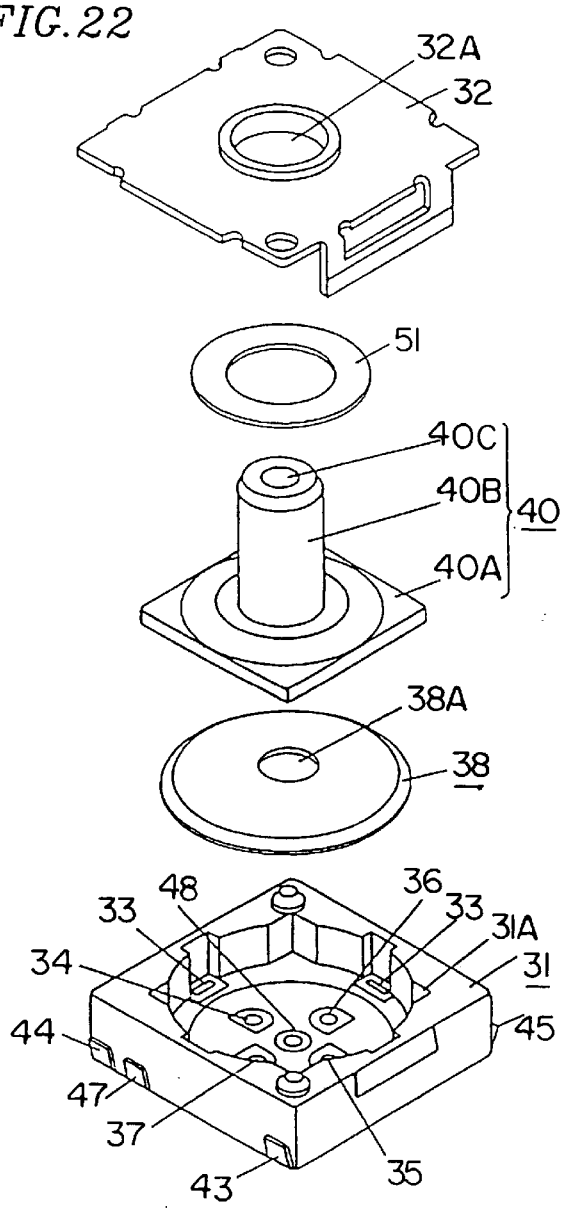

FIG. 22 is an exploded perspective view illustrating the multidirectional operating switch of FIG. 21.

Figure 23:
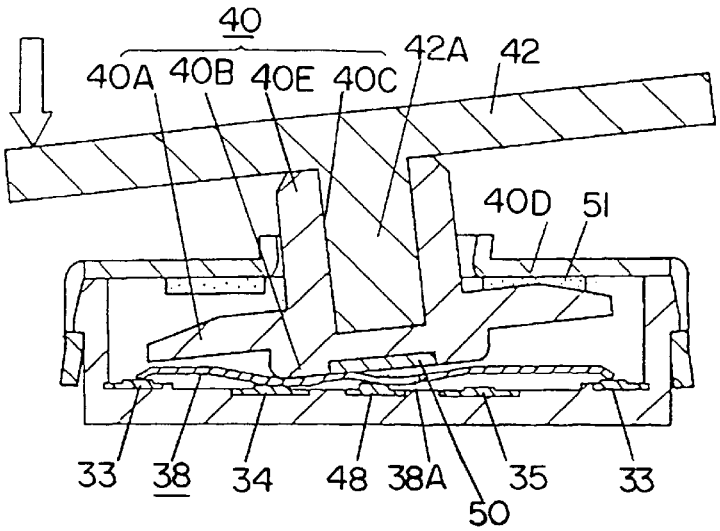

FIG. 23 is a cross-sectional view schematically illustrating a certain operation state of the multidirectional operating switch of FIG. 21.

Figure 24:
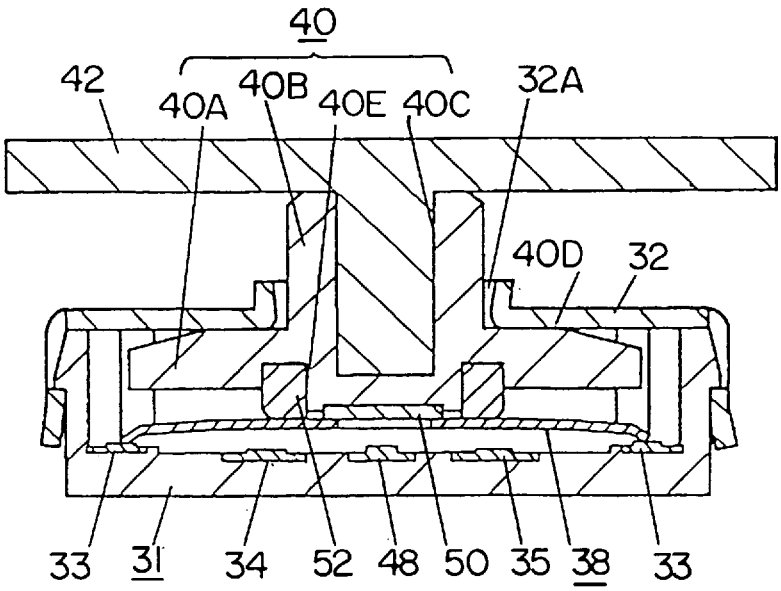

FIG. 24 is a cross-sectional view illustrating a configuration of a multidirectional operating switch according to Example 6 of the present invention.

Figure 25:
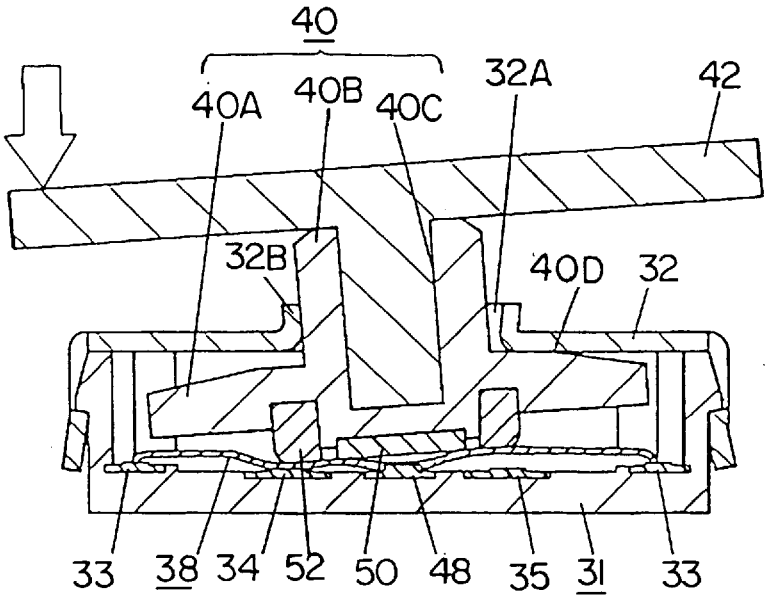

FIG. 25 is a cross-sectional view schematically illustrating a certain operation state of the multidirectional operating switch of FIG. 24.

Figure 26:
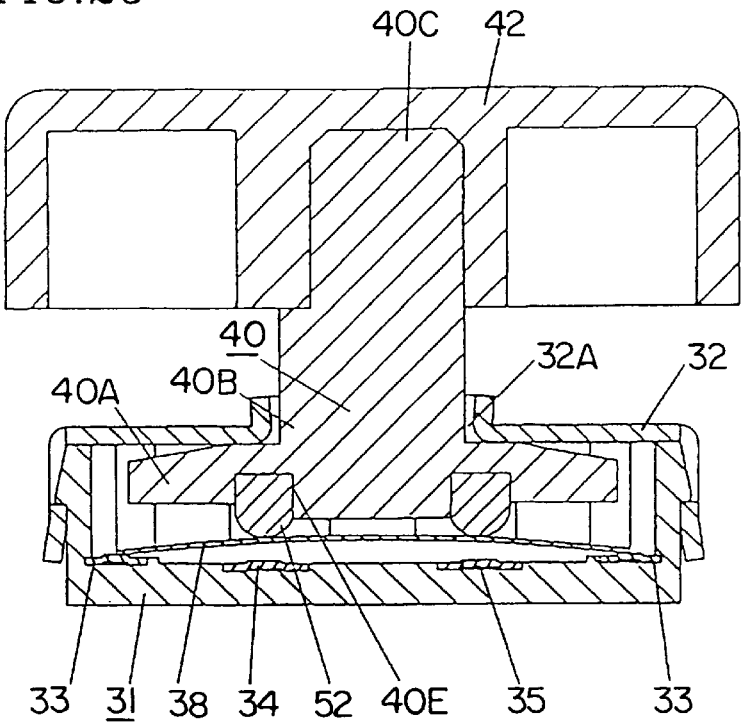

FIG. 26 is a cross-sectional view illustrating an alternative configuration of the multidirectional operating switch according to Example 6 of the present invention.

Figure 27:
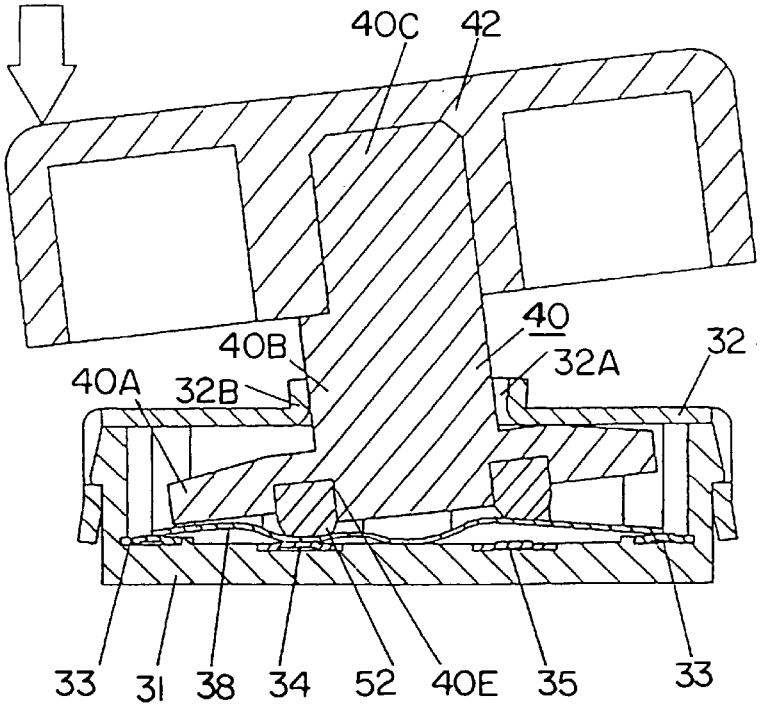

FIG. 27 is a cross-sectional view schematically illustrating a certain operation state of the multidirectional operating switch of FIG. 26.

Figure 28:
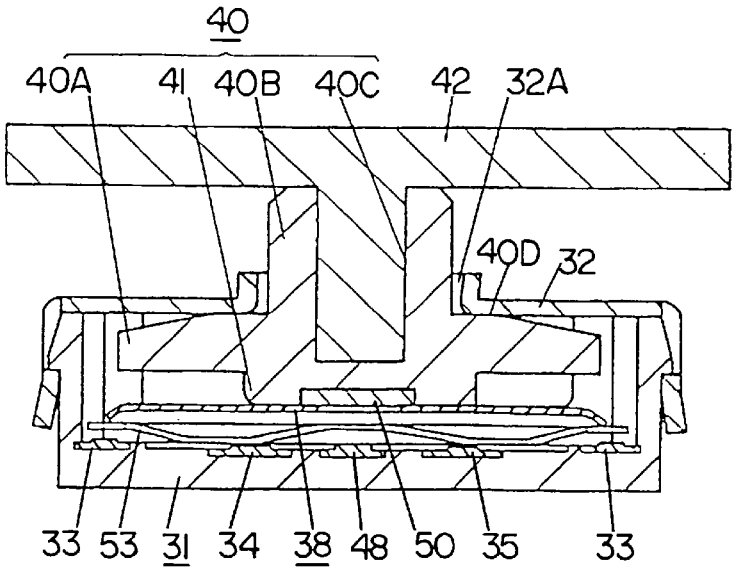

FIG. 28 is a cross-sectional view illustrating a configuration of a multidirectional operating switch according to Example 7 of the present invention.

Figure 29:
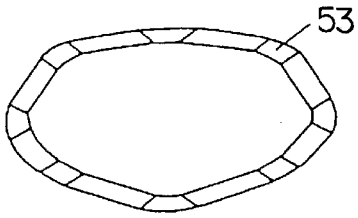

FIG. 29 is a perspective view schematically illustrating the shape of the conductive resilient member included in the multidirectional operating switch of FIG. 28.

Figure 30:
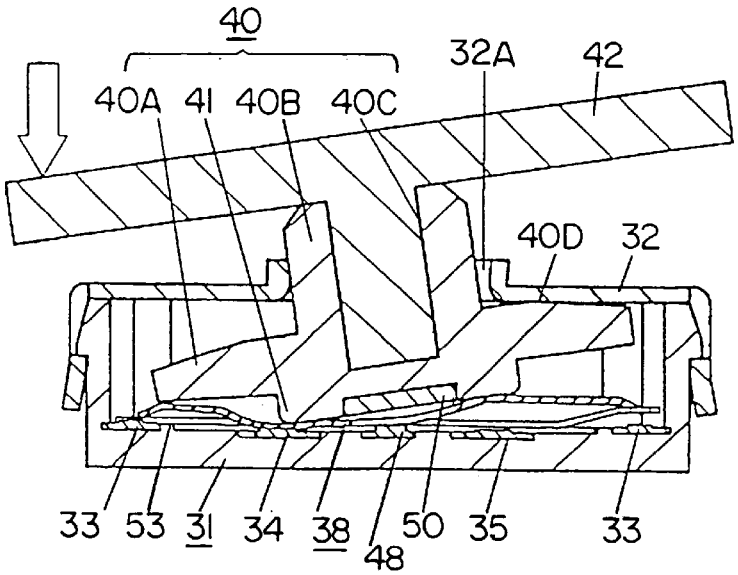

FIG. 30 is a cross-sectional view schematically illustrating a certain operation state of the multidirectional operating switch of FIG. 28.

Figure 31:
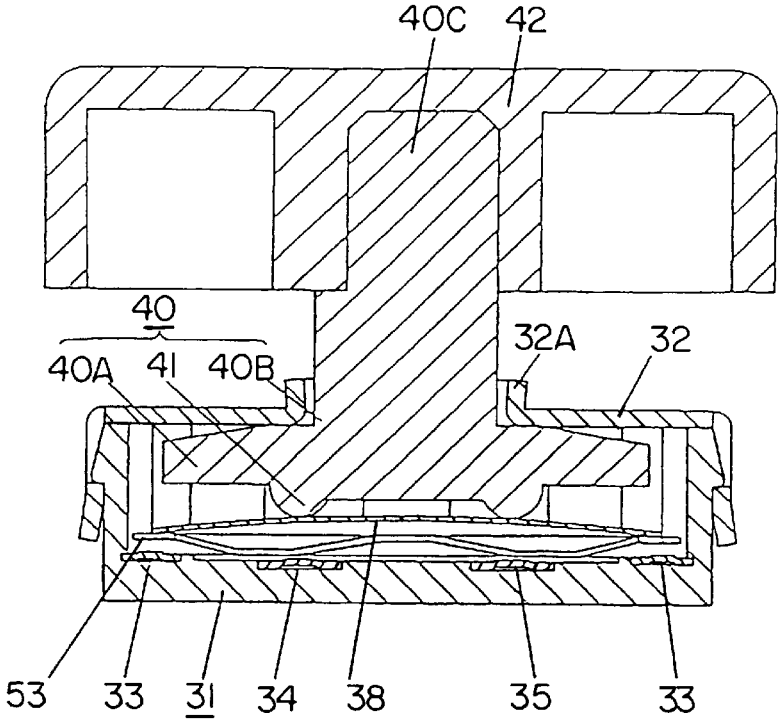

FIG. 31 is a cross-sectional view illustrating an alternative configuration of the multidirectional operating switch according to Example 7 of the present invention.

Figure 32:
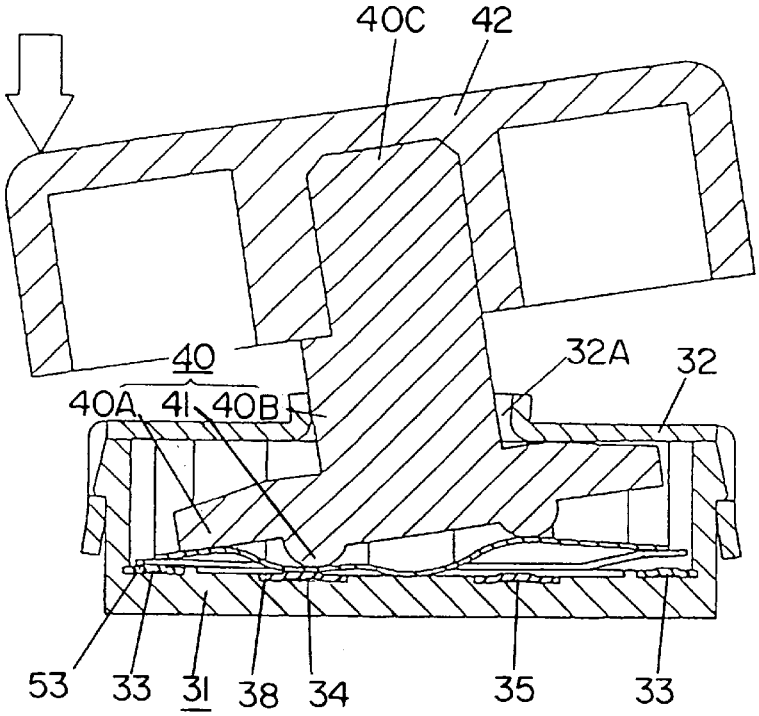

FIG. 32 is a cross-sectional view schematically illustrating a certain operation state of the multidirectional operating switch of FIG. 31.

Figure 33:
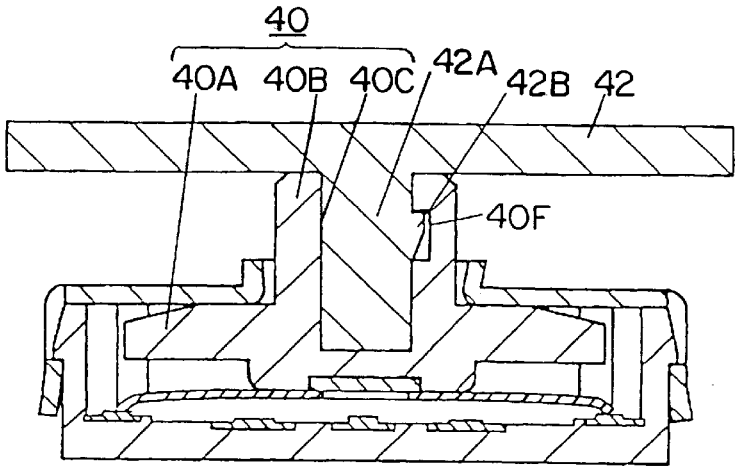

FIG. 33 is a cross-sectional view illustrating a configuration of a multidirectional operating switch according to Example 8 of the present invention.

Figure 34:
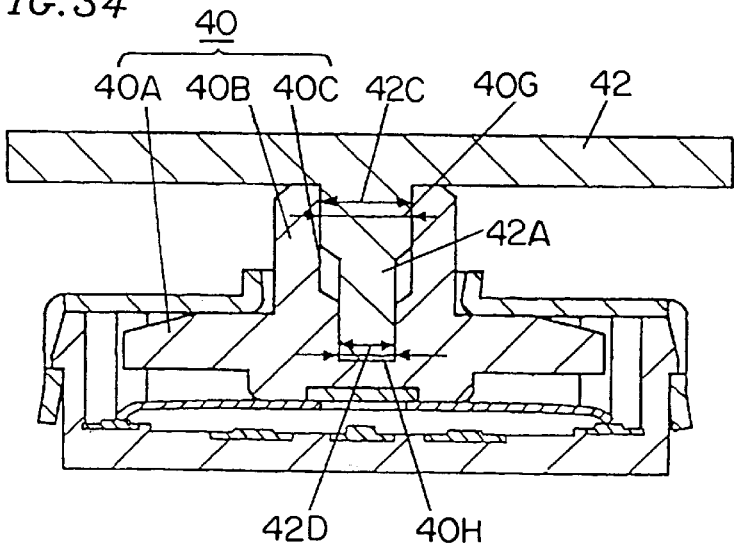

FIG. 34 is a cross-sectional view illustrating a configuration of a multidirectional operating switch according to Example 9 of the present invention.

Figure 35:
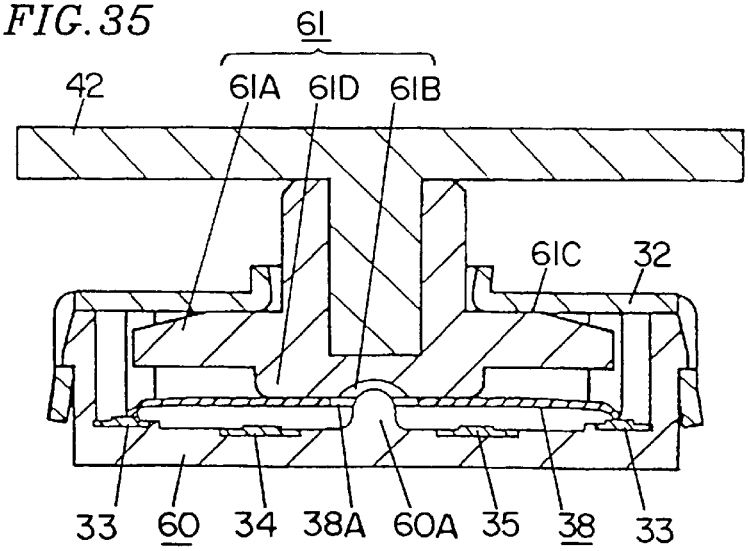

FIG. 35 is a cross-sectional view illustrating a configuration of a multidirectional operating switch according to Example 10 of the present invention.

Figure 36A:
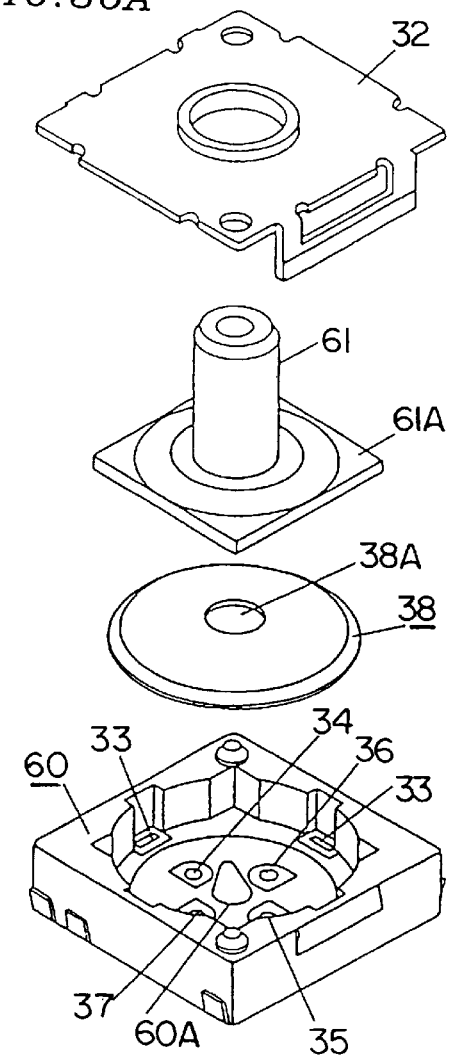

FIG. 36A is an exploded perspective view illustrating the multidirectional operating switch of FIG. 35.

Figure 36B:
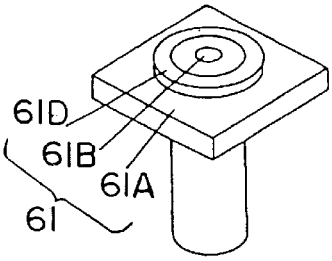

FIG. 36B is a perspective view illustrating an operating member which is the main component in the configuration of the multidirectional operating switch of FIG. 35.

Figure 37:
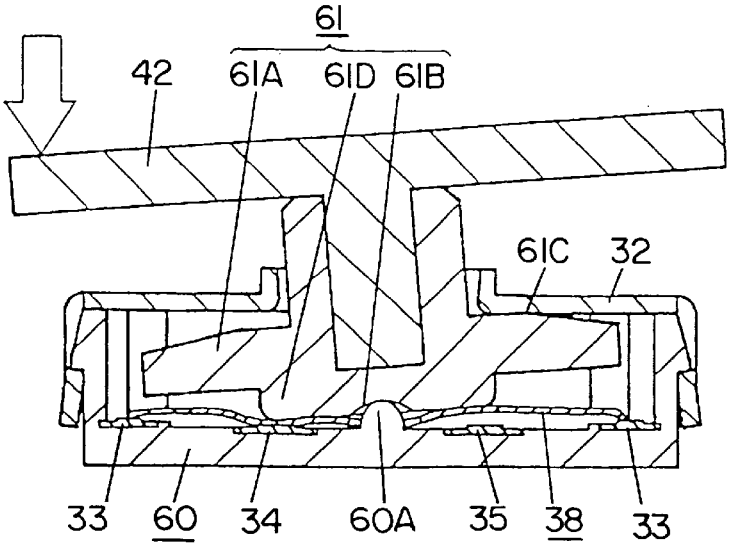

FIG. 37 is a cross-sectional view schematically illustrating a certain operation state of the multidirectional operating switch of FIG. 35.

DESCRIPTION OF THE PREFERRED EMBODIMENTS

EXAMPLE 1

FIG. 5 is a cross-sectional view illustrating a configuration of a multidirectional operating switch according to Example 1 of the present invention. Moreover, FIG. 6A is an exploded perspective view illustrating the multidirectional operating switch illustrated in FIG. 5; and FIG. 6B is a perspective view illustrating an operating member which is the main component in the configuration.

The illustrated multidirectional operating switch includes a box-shaped case 31, with the opening thereof being covered by a cover 32 made of a metal plate, or the like. Four outer fixed contacts 33, a central fixed contact 48, and four inner fixed contacts 34 to 37 are fixed by the insert molding on the bottom surface of the case 31. As shown in the plan view of FIG. 7, an outer peripheral lower end portion of the dome-shaped movable contact 38, which is made of a resilient metal thin plate with a hole 38A provided at the center thereof, is placed on the four outer fixed contacts 33; the central fixed contact 48 is located under the center of the dome-shaped movable contact 38; and the four inner fixed contacts 34 to 37 are provided along the periphery about the center of the central fixed contact 48 so as to be equally spaced apart from one another. Each of the four inner fixed contacts 34 to 37 is located substantially at the midpoint between the central fixed contact 48 and the corresponding one of the outer fixed contacts 33. The central fixed contact 48 is provided so as to be smaller than the hole 38A which is provided at the center of the dome-shaped movable contact 38 and taller than the inner fixed contacts 34 to 37. The fixed contacts 33 to 37 and 48 are connected respectively to the terminals 43 to 47 and 49 for connection to an external circuit.

The number of pairs of the outer fixed contact 33 and the terminal connected thereto is not limited to four, as illustrated, but may also be one, for example.

As illustrated in the perspective view of FIG. 8A and the cross-sectional view of FIG. 8B, the dome-shaped movable contact 38 is formed by a drawing process of a resilient metal thin plate into a circular dome-like shape with the hole 38A being provided at the center thereof. The dome-shaped movable contact 38 includes an outer peripheral portion 38B which is in a frustum shape and a central portion 38C, which is in a substantially spherical shape slightly raised upwards, inside the outer peripheral portion 38B. At the boundary therebetween, the portions 38B and 38C are connected to each other by a smooth curve.

An operating member 40 includes a shaft portion 40B and a rectangular flange portion 40A formed integrally with the shaft portion 40B on the lower end thereof. The shaft portion 40B extends upwards out of a through hole 32A provided at the center of the cover 32. On the other hand, the flange portion 40A is engaged with and supported by corner portions 31A provided at four locations of the inner wall of the case 31 so that the flange portion 40A cannot rotate but can tilt and move vertically.

A pressing portion (inner pressing portion) 41 is provided on the lower surface of the flange portion 40A of the operating member 40. The pressing portion 41 is formed into a circular ring shape so that stepped portion along the outer periphery thereof is placed along the respective centers of the inner fixed contacts 34 to 37 provided on the bottom surface of the case 31. A conductive member 50 is provided in an indentation 41A which is provided at the center of the circular ring-shaped inner pressing portion 41. The conductive member 50 forms a central pressing portion which is larger than the hole 38A provided at the center of the dome-shaped movable contact 38. The conductive member 50 is as tall as the inner pressing portion 41 or extends slightly taller than the inner pressing portion 41.

The dome-shaped movable contact 38 is positioned by a circular portion of the inner wall of the case 31 so as to be concentric with the case 31, and is placed on the outer fixed contacts 33 provided on the bottom surface of the case 31. The lower surface of the flange portion 40A of the operating member 40 is biased upwards by the upper surface portion of the dome-shaped movable contact 38 pressing against the inner pressing portion 41. As a result, the upper surface of the flange portion 40A is biased upwards against the inner or lower surface of the cover 32, whereby the operating member 40 maintains the vertical and neutral position.

A hole 40C is provided to run from the upper end surface of the shaft portion 40B of the operating member 40 down to the flange portion 40A so as to be longer than the distance by which the shaft portion 40B extends out of the cover 32. A leg portion 42A of the operating knob 42 is inserted and coupled to the hole 40C.

Hereinafter, the operation of the multidirectional operating switch of the present example having such a configuration will be described further referring to FIGS. 9 and 10 as well as FIG. 5. Each of FIGS. 9 and 10 is a cross-sectional view schematically illustrating a certain operation state of the multidirectional operating switch of the present example.

In the state shown in FIG. 5, the operating member 40 is in the vertical and neutral position, with the inner pressing portion 41 on the lower surface thereof not depressing the dome-shaped movable contact 38 below its resting position. In this state, connection between any pair of the contacts is in the OFF state.

When an end of the knob 42 (the left end in the example illustrated in FIG. 9) is pressed down as indicated by an arrow in FIG. 9, the operating member 40 is tilted about a fulcrum at a top portion 40D on the upper surface of the flange portion 40A which is in contact with the inner surface of the cover 32. Thus, the inner pressing portion 41 on the lower surface of the operating member 40 presses down the dome-shaped movable contact 38 so as to partially invert the dome-shaped movable contact 38, thereby generating a click, causing the dome-shaped movable contact 38 to contact the inner fixed contact 34 provided at the corresponding position on the bottom surface of the case 31, and thus turning ON the connection between the outer fixed contact 33 and the inner fixed contact 34. Thus, a signal is generated, which is then supplied to the outside through the terminals 43 and 44.

At this point, if the central portion of the dome-shaped movable contact 38 is inverted toward the bottom surface of the case 31, the central fixed contact 48 will not contact the dome-shaped movable contact 38 since the central fixed contact 48 is smaller than the hole 38A provided at the center of the dome-shaped movable contact 38. Moreover, the conductive member 50 is lifted so as to come off the central fixed contact 48 about a fulcrum at the stepped portion on the outer periphery of the ring-shaped inner pressing portion 41, so that it, like the contact 38, will not contact the central fixed contact 48.

When the force being applied to the knob 42 is removed, the inner pressing portion 41 on the lower surface of the flange portion 40A of the operating member 40 is pushed up by virtue of the restoring force of the dome-shaped movable contact 38, to be moved back into the vertical and neutral position, whereby the dome-shaped movable contact 38 comes off the inner fixed contact 34, thus turning the switch contact back to the OFF state.

As described above, by pressing down the upper surface of the knob 42 at a certain point thereof, a signal is supplied from the switch to the outside through one of the terminals 45 to 47 which corresponds to the pressed position (direction).

When a switching operation is performed by tilting the operating member 40 by pressing down an end portion of the upper surface of the knob 42, the operating member 40, i.e., the knob 42, will not rotate since the flange portion 40A of the operating member 40 and the inner wall of the case 31 are fitted together at the four corner portions 31A in a rectangular shape. This makes it possible to easily and reliably turn ON the connection between intended contacts.

Moreover, when a switching operation is performed by tilting the knob 42, i.e., the operating member 40, a lateral shaking force acts upon the coupling portion between the hole 40C of the shaft portion 40B of the operating member 40 and the leg portion 42A of the knob 42. However, clattering therebetween is slight since the hole 40C and the leg portion 42A are coupled together by being fitted together over a long distance.

Referring now to FIG. 10, when the operating member 40 is pressed down by pressing vertically down on the central portion of the upper surface of the knob 42, i.e., the shaft portion 40B of the operating member 40, as indicated by an arrow in FIG. 10, the inner pressing portion 41 and the conductive member 50 press down the dome-shaped movable contact 38. This inverts the dome-shaped movable contact 38 and generates a click while the dome-shaped movable contact 38 and the central fixed contact 48 contact each other via the conductive member 50, thereby turning ON the connection between the outer fixed contact 33 and the central fixed contact 48. Thus, a signal is generated, which is then supplied to the outside through the terminal 49.

When the force being applied to the knob 42 is removed, the operating member 40 is pushed up by virtue of the restoring force of the dome-shaped movable contact 38 so as to be moved back into the vertical and neutral position.

As described above, in the multidirectional operating switch according to the present example, the plurality of inner fixed contacts 34 to 37 and the central fixed contact 48 are provided under the single dome-shaped movable contact 38, thus enabling performance of switching operations corresponding to the respective directions in which the shaft portion 40B is tilted and vertically pressed down. This reduces the number of components to be provided, the outer diameter and the thickness of the switch, and also the cost thereof. Moreover, even during a tilting operation, the inner pressing portion 41 presses down and partially inverts the dome-shaped movable contact 38, thus generating a clear click.

Separate inner pressing portions 41 may be provided individually at positions corresponding respectively to the inner fixed contacts 34 to 37. Alternatively, the inner pressing portion 41 may be formed into a polygonal ring shape with apexes at positions corresponding respectively to the inner fixed contacts 34 to 37. Moreover, the stepped portion of the inner pressing portion 41 may have a slightly curved surface. Furthermore, the entire inner pressing portion 41 may be formed as a conductive member.

Moreover, when the conductive member 50 to be the central pressing portion is formed of a material which has some resilience, the contacts can be protected by the resilience. Furthermore, when the central pressing portion 50 and the inner pressing portion 41 are formed of an integral conductive member, the structure of the lower surface of the flange portion 40A becomes simple, which is advantageous in view of downsizing.

Generally, the operating feeling with a click can be diagrammatized as in the characteristic diagram of FIG. 11. The characteristic diagram of FIG. 11 shows variation in the operating force with respect to the operating stroke when pressing down the dome-shaped movable contact. Normally, a preferable operating feeling is said to be obtained when the ratio B/A between the inverting force A of the dome-shaped movable contact and the repulsive return force B thereof is about 40% to about 60%.

Next, the results of a study for the shape of the dome-shaped movable contact 38 which satisfies the aforementioned preferable condition in the multidirectional operating switch of the present example will be described with reference to FIGS. 12A and 12B.

In view of the shape of the multidirectional operating switch of the present example, particularly, the arrangement of the outer fixed contact 33, the inner fixed contacts 34 to 37 and the central fixed contact 48 provided on the bottom surface of the case 31, it is desirable to locate each of the inner fixed contacts 34 to 37 substantially at the midpoint between the central fixed contact 48 and the corresponding one of the outer fixed contacts 33. This is for reliably ensuring the electrical insulation distance between the fixed contacts, and it particularly applies when downsizing the switch. Thus, on a precondition of the ratio d/D=50% between the outer diameter D of the dome-shaped movable contact 38 and the diameter d of the inner pressing portion 41, the shape of the dome-shaped movable contact 38 which results in the optimal operating feeling was studied, for the case where the dome-shaped movable contact 38 is pressed down by the stepped portion of the inner pressing portion 41, while varying the angle θ between the bottom surface of the dome-shaped movable contact 38 and the slope of the peripheral conically-shaped portion thereof, and the ratio h/H between the total height H of the dome-shaped movable contact 38 and the height h of the conically-shaped portion thereof.

FIG. 12B is a partial cross-sectional view schematically illustrating the dome-shaped movable contact 38 and the inner pressing portions 41, which shows D, d, θ, H and h. FIG. 12A shows values of the above-mentioned ratio B/A for various combinations of θ and h/H, with the horizontal axis representing θ and the vertical axis representing h/H.

As is apparent from the graph of FIG. 12A, plots "◎", indicating the ratio B/A between the inverting force A and the repulsive return force B is 40% to 60% (where the dome-shaped movable contact 38 is generally said to give a preferable operating feeling), exist in the region where θ=about 25° to about 35° and h/H=about 70% to about 95%. Although the results shown in FIG. 12A were obtained with the ratio d/D being fixed at 50%, similar results were obtained when the same study was made while varying the ratio d/D in the range of about 40% to about 60%.

As can be seen from the above results, by using the dome-shaped movable contact 38 having a shape which satisfies both θ=about 25° to about 35° and h/H=about 70% to about 95%, a good and clear click is obtained when the knob 42, i.e., the operating member 40 is either tilted or pushed down. Thus, a good operability can be realized.

EXAMPLE 2

Next, a multidirectional operating apparatus using the multidirectional operating switch described in Example 1 will be described.

As described above, in the multidirectional operating of the present invention, a switching operation can be performed in any of four directions by tilting the shaft portion 40B of the operating member 40 toward one of the directions in which the inner fixed contacts 34 to 37 are arranged. When the shaft portion 40B of the operating member 40 is tilted toward a direction between adjoining two of the inner fixed contacts, the operating member 40 is tilted about a fulcrum at a top portion located opposite to the tilting direction on the upper surface of the flange portion 40A being in contact with the reverse or inner surface of the cover 32. Thus, the two inner fixed contacts close to the direction in which the operating member 40 is tilted are both turned ON.

In the multidirectional operating apparatus using the multidirectional operating switch of the present invention having such a configuration, a predetermined switching recognition circuit section may be provided in a microcomputer (not shown) which is connected to an external output terminal. Thus, if the adjoining two of the switch contacts are turned ON at shifted timings when the shaft portion 40B of the operating member 40 is tilted toward a direction between adjoining two of the inner fixed contacts, the amount of time by which the timings are shifted from each other is measured. A time measurement circuit section may further be provided in the microcomputer so that it is determined that the two contacts are simultaneously turned ON if the measured shift time (timing difference) is within a predetermined time difference, which will then be processed as a signal different from a signal obtained when only one individual switch contact is turned ON. Thus, it is possible to process different signals associated respectively with directions twice as many as the number of the inner fixed contacts provided.

For example, when four inner fixed contacts are provided as in Example 1, signal detection is enabled in eight directions as described above.

EXAMPLE 3

FIG. 13 is a cross-sectional view illustrating a configuration of a multidirectional operating switch according to Example 3 of the present invention, and FIG. 14 is an exploded perspective view illustrating the multidirectional operating switch of FIG. 13. Moreover, FIG. 15 is a plan view illustrating the multidirectional operating switch of FIG. 13.

The configuration of the multidirectional operating switch of the present example is basically the same as that described in Example 1. In this example, however, a central fixed contact is not provided on the bottom surface of the case 31. Like components are given like reference numerals and may not be further described below, except where necessary.

Specifically, the illustrated multidirectional operating switch includes the box-shaped case 31 made of a resin, with the opening thereof being covered by the cover 32 made of a metal plate, or the like. The four outer fixed contacts 33 and the four inner fixed contacts 34 to 37 are fixed by the insert molding on the bottom surface of the case 31. The outer peripheral lower end portion of the dome-shaped movable contact 38, which is made of a resilient thin metal plate, is placed on the four outer fixed contacts 33. The four inner fixed contacts 34 to 37 are provided along the periphery about the center of the dome-shaped movable contact 38 so as to be equally spaced apart from one another. Each of the four inner fixed contacts 34 to 37 is located closer to the center than the corresponding one of the outer fixed contacts 33. The fixed contacts 33 to 37 are connected respectively to the terminals 43 to 47 for connection to an external circuit.

FIG. 16A is a cross-sectional view schematically illustrating a certain operation state of the multidirectional operating switch of the present example.

The height of the inner fixed contacts 34 to 37 is set so that the difference H (see FIG. 16B) between the inner fixed contacts 34 to 37 and a central portion 31B of the bottom surface of the case 31, with which the central portion of the lower surface of the inverted dome-shaped movable contact 38 comes in contact, is such that none of the inner fixed contacts 34 to 37 except for the one in the tilting direction will contact the dome-shaped movable contact 38 when the operating member 40 is tilted by pressing down the upper surface thereof as indicated by an arrow in FIG. 16 so that the dome-shaped movable contact 38 is-inverted.

Each of FIGS. 17A and 17B is a plan view schematically illustrating an exemplary shape of the dome-shaped movable contact 38 according to the present example.

By providing slits 38B or ribs 38C in the dome-shaped movable contact 38, as shown these figures, it is possible to reduce the amount of inverted-movement, by which portions of the dome-shaped movable contact 38 other than the pressed portion thereof are inverted and shifted as the dome-shaped movable contact 38 is inverted by tilting the operating member 40. Thus, a large insulation distance can be ensured between the inner fixed contacts and the dome-shaped movable contact 38 except for the portion being pressed, and it is thus possible to realize a reliable and stable switching operation and also to eliminate a click.

The operation of the multidirectional mechanism of the present example, having the above-described configuration, is the same as that of the multidirectional operating switch of Example 1 except that the present example includes a different push operation of the operating member 40. Moreover, an apparatus using this multidirectional operating switch may be configured similarly to the apparatus of Example 2, which is configured using the multidirectional operating switch of Example 1.

Furthermore, as shown in FIG. 18, when a force is applied vertically on the center of the upper surface of the knob 42, i.e., when vertically pressing down the operating member 40, the pressing portion 41 presses the dome-shaped movable contact 38. This inverts the dome-shaped movable contact 38, thereby generating a click. Moreover, two or more of the inner fixed contacts 34 to 37 are turned ON. Specifically, at least one diagonally-located pair of the inner fixed contacts 34 to 37 is turned ON.

Moreover, in the apparatus using the multidirectional operating switch of the present invention having such a configuration, a predetermined switching recognition circuit section may be provided in a microcomputer (not shown) which is connected to an external output terminal. Thus, if the diagonally-located two switch contacts are turned ON at shifted timings, the amount of time by which the timings are shifted from each other is measured, as in the case where the operating member 40 is tilted toward a direction between adjoining two of the inner fixed contacts (see the description in Example 2). A time measurement circuit section may further be provided in the microcomputer so that it is determined that the two contacts are simultaneously turned ON if the measured timing difference is within a predetermined time difference, which will then be processed as a signal different from a signal obtained when only one individual switch contact is turned ON. Thus, a switching process by a push operation is possible even in the case where a central fixed contact is not provided on the bottom surface of the case 31, as in the multidirectional operating switch of the present example. It is possible to process different signals associated respectively with directions twice as many as the number of the inner fixed contacts provided.

EXAMPLE 4

FIG. 19 is a cross-sectional view illustrating a multidirectional operating switch according to Example 4 of the present invention. Moreover, FIG. 20 is a plan view illustrating the multidirectional operating switch of FIG. 19.

The configuration of the multidirectional operating switch of the present example is basically the same as that described in Example 3. In this example, however, a central fixed contact 160 is provided on the bottom surface of the case 31, and the central fixed contact 160 is connected further to an external output terminal 161. A central pressing portion 162 which corresponds to the central fixed contact 160 is provided on the lower surface of the operating member 40. Like components are given like reference numerals and may not be further described below, except where necessary.

In the configuration of the present example, the height of the inner pressing portion 41, which is provided on the lower surface of the operating member 40, above the lower surface of the operating member 40 is set to be less than that of the central pressing portion 162. Thus, the inner pressing portion 41 does not press down the dome-shaped movable contact 38 even when the operating member 40 is pressed down by applying a force vertically on the knob 42 so that the central pressing portion 162 of the operating member 40 inverts the dome-shaped movable contact 38.

The operation of the multidirectional mechanism of the present example having the above-described configuration is substantially the same as that of the multidirectional operating switch of Example 1. Moreover, an apparatus using this multidirectional operating switch may be similarly configured as the apparatus of Example 2 which is configured using the multidirectional operating switch of Example 1.

EXAMPLE 5

FIG. 21 is a cross-sectional view illustrating a configuration of a multidirectional operating switch according to Example 5 of the present invention. FIG. 22 is an exploded perspective view illustrating the multidirectional operating switch of FIG. 21. Moreover, FIG. 23 is a cross-sectional view schematically illustrating a certain operation state of the multidirectional operating switch of the present example.

The multidirectional operating switch of the present example, as compared to the multidirectional operating switch of Example 1, differs in that a resilient member 51 made of a sheet-like rubber, or the like, is further inserted between the upper surface of the flange portion 40A of the operating member 40 and the inner surface of the cover 32. Other than that, the configuration is the same as that of Example 1. Like components are given like reference numerals and may not be further described below, except where necessary.

By providing the resilient member 51 as described above, even if there occurs slight dimensional fluctuation or variation when processing or assembling the case 31, the cover 32, the operating member 40 and the dome-shaped movable contact 38, such a dimensional fluctuation or variation may be absorbed by the resilient member 51 being depressed, as long as the fluctuation or variation is within the depression limit of the resilient member 51. Thus, there occurs no clattering in the operating member 40.

Moreover, when an end of the knob 42 (the left end in the example illustrated in FIG. 23) attached to the hole 40C of the operating member 40 is pressed down, as indicated by an arrow in FIG. 23, the operating member 40 is tilted about a fulcrum at the top portion 40D on the right side of the upper surface of the flange 40A. Thus, the inner pressing portion 41 presses down the dome-shaped movable contact 38 so as to partially invert the dome-shaped movable contact 38. As a result, a click is generated, while the inner fixed contact 34 provided at the corresponding position on the bottom surface of the case 31 and the dome-shaped movable contact 38 contact each other, thereby turning ON the connection between the outer fixed contact 33 and the inner fixed contact 34. Thus, a signal is generated, which is then supplied to the outside through the terminals 43 and 44.

In the above-described operation, the resilient member 51 is pressed locally by a top portion 40D, and a portion of the resilient member 51 is compressed and deformed more than the other portions thereof. Thus, the tilting angle of the shaft portion 40B of the operating member 40 can be increased. Moreover, the resilient member 51 is further compressed and deformed so as to absorb the impact force generated when the shaft portion 40B is tilted, or a force generated when an abnormal force is applied to the operating member 40, thereby protecting the switch contact section.

EXAMPLE 6

FIG. 24 is a cross-sectional view illustrating a configuration of a multidirectional operating switch according to Example 6 of the present invention, and FIG. 25 is a cross-sectional view schematically illustrating a certain operation state of the multidirectional operating switch of the present example.

The multidirectional operating switch of the present example, as compared to the multidirectional operating switch of Example 1, differs in that the inner pressing portion on the lower surface of the operating member 40, which corresponds to the inner fixed contacts 34 to 37 on the bottom surface of the case 31, is formed of a resilient member 52 such as rubber. Specifically, the resilient member 52 is press-fitted within a ring-shaped dent 40E provided on the lower surface of the operating member 40. Other than that, the configuration is the same as that of Example 1. Like components are given like reference numerals and may not be further described below, except where necessary.

While the resilient member 52 is in contact with the dome-shaped movable contact 38 which is placed on the outer fixed contacts 33 on the bottom surface of the case 31, the compressive deformation force thereof is set to be larger than the inversion force of the dome-shaped movable contact 38. Therefore, when an end of the knob 42 (the left end in the example illustrated in FIG. 25) is pressed down, as indicated by an arrow in FIG. 25, the operating member 40 is tilted about a fulcrum at the top portion 40D on the right side of the upper surface of the flange 40A. Thus, the resilient member 52 on the lower surface of the operating member 40 presses down and partially inverts the dome-shaped movable contact 38. As a result, a click is generated, while the inner fixed contact 34 provided at the corresponding position on the bottom surface of the case 31 and the dome-shaped movable contact 38 contact each other, thereby turning ON the connection between the outer fixed contact 33 and the inner fixed contact 34. Thus, a signal is generated, which is then supplied to the outside through the terminals 43 and 44.

In the above-described operation, when a great force is applied to the knob 42, the resilient member 52 is compressed and deformed so as to absorb the force. Moreover, the shaft portion 40B of the operating member 40 is pressed against a wall portion 32B which is provided around the through hole 32A at the center of the cover 32, whereby the operating member 40 is prevented from being further tilted. Furthermore, when a great impact force is applied downwards on the central portion of the upper surface of the operating member 40 via the knob 42, the resilient member is compressed and deformed so as to absorb the impact force, thereby preventing damage from occurring.

The present example has been described above as a modification of the configuration of Example 1. However, as illustrated in FIGS. 26 and 27 as a modification of the configuration of Example 3, which has been described with reference to FIGS. 13 and 14, it is also possible to provide the resilient member 52 of the present example in the ring-shaped dent 40E provided on the lower surface of the operating member 40.

EXAMPLE 7

FIG. 28 is a cross-sectional view illustrating a configuration of a multidirectional operating switch according to Example 7 of the present invention.

The multidirectional operating switch of the present example, as compared to the multidirectional operating switch of Example 1, differs in that a conductive resilient member 53 as illustrated in the perspective view of FIG. 29 is provided between the dome-shaped movable contact 38 and the outer fixed contacts 33 of the case 31. The conductive resilient member 53 has a repulsive force slightly smaller than the inversion force of the dome-shaped movable contact 38. With the provision of the conductive resilient member 53, the dome-shaped movable contact 38 is slightly "lifted" from the bottom surface of the case 31. Other than that, the configuration is the same as that of Example 1. Like components are given like reference numerals and may not be further described below, except where necessary.

FIG. 30 is a cross-sectional view schematically illustrating a certain operation state of the multidirectional operating switch of the present example.

When an end of the knob 42 (the left end in FIG. 30) is pressed down, as indicated by an arrow in FIG. 30, the operating member 40 is tilted about a fulcrum at the top portion 40D on the right side of the upper surface of the flange 40A. Thus, the inner pressing portion 41 on the lower surface of the operating member 40 presses down the dome-shaped movable contact 38. At this point, the conductive resilient member 53 between the dome-shaped movable contact 38 and the outer fixed contacts 33 of the case 31 is compressed, whereby the dome-shaped movable contact 38 pressed down by the inner pressing portion 41 is partially inverted while the left side in the figure of the flange portion 40A is tilted more than at the corresponding stage in Example 1. Thus, a click is generated, while the inner fixed contact 34 provided at the corresponding position on the bottom surface of the case 31 and the dome-shaped movable contact 38 contact each other, thereby turning ON the connection between the outer fixed contact 33 and the inner fixed contact 34. Thus, a signal is generated, which is then supplied to the outside through a terminal (not shown).

When the force being applied to the knob 42 is removed, the inner pressing portion 41 is pushed up by virtue of the restoring force of the dome-shaped movable contact 38 and the conductive resilient member 53 so that the operating member 40 comes back into the vertical and neutral position. Thus, the dome-shaped movable contact 38 comes off the inner fixed contact 34, thereby turning the switch back to the OFF state.

As described above, also in the configuration of the multidirectional operating switch of the present example, by pressing down the upper surface of the knob 42 at a certain point thereof, a signal is supplied from the switch to the outside through a terminal (not shown) which corresponds to the pressed position (direction). Particularly in the configuration of the present example, a large insulation distance can be ensured between the inner fixed contacts 34 to 37 and the dome-shaped movable contact 38 so that they will not easily contact each other in the neutral state, whereby it is possible to prevent a malfunction of the switch from occurring, to tilt the operating member 40 by a larger angle, and to perform a reliable and stable switching operation.

The present example has been described above as a modification of the configuration of Example 1. However, as illustrated in FIGS. 31 and 32 as a modification of the configuration of Example 3, which has been described with reference to FIGS. 13 and 14, it is also possible to provide the conductive resilient member 53 of the present example between the dome-shaped movable contact 38 and the outer fixed contacts 33 of the case 31.

EXAMPLE 8

FIG. 33 is a cross-sectional view illustrating a configuration of a multidirectional operating switch according to Example 8 of the present invention.

The multidirectional operating switch of the present example, as compared to the multidirectional operating switch of Example 1, differs in that a protruding stopper nail 42B is further provided on the periphery of the leg portion 42A of the knob 42 which is inserted and coupled to the hole 40C of the operating member 40. Moreover, an engaging dent 40F is further provided on the inner wall surface of the hole 40C so as to engage with the protruding stopper nail 42B. Other than that, the configuration is the same as that of Example 1. Like components are given like reference numerals and are not further described below.

Due to such a configuration, it is possible to reliably secure the leg portion 42A of the knob 42 within the hole 40C of the operating member 40 so that it can not be detached therefrom during operation.

EXAMPLE 9

FIG. 34 is a cross-sectional view illustrating a configuration of a multidirectional operating switch according to Example 9 of the present invention.

The multidirectional operating switch of the present example is different from the multidirectional operating switch of Example 1 in the configuration of the section where the hole 40C of the operating member 40 and the leg portion 42A of the knob 42 fit each other. Specifically, an upper portion 40G of the hole 40C has a relatively large diameter, whereas a lower portion 40H thereof has a relatively small diameter. Accordingly, an upper portion 42C of the leg portion 42A has a relatively large diameter, whereas a lower portion 42D thereof has a relatively small diameter. The knob 42 is attached to the operating member 40 by press-fitting the upper portions 40G and 42C together, and the lower portions 40H and 42D together. Other than that, the configuration is the same as that of Example 1. Like components are given like reference numerals and may not be further described below, except where necessary.

Also in the configuration of the multidirectional operating switch of the present example, as in the configuration of the multidirectional operating switch of Example 1, the length, from the upper end of the upper portion having a large diameter to the lower end of the lower portion having a small diameter, is set to be greater than the distance by which the shaft portion 40B is extending out of the cover 32. Therefore, the effective distance over which the operating member 40 and the knob 42 fit together has the same value as in the configuration of the multidirectional operating switch of Example 1. Thus, it is possible to reduce the clattering in the section where the hole 40C of the operating member 40 and the leg portion 42A of the knob 42 fit each other.

Moreover, the resistance against a mechanical stress generated as the knob 42 is tilted can be increased without increasing the outer diameter of the shaft portion 40B of the operating member 40, by setting the thickness to a large value at the lower portion of the shaft portion 40B of the operating member 40, to which a great force is applied when tilting the knob 42, and at the upper portion 42C of the leg portion 42A of the knob 42 having a large diameter, to which a great force is similarly applied, while setting the thickness to a small value at the upper portion of the shaft portion 40B of the operating member 40, to which a great force is not applied when tilting the knob 42, and at the lower portion 42D of the leg portion 42A of the knob 42 having a small diameter, to which a great force is similarly not applied.

EXAMPLE 10

FIG. 35 is a cross-sectional view illustrating a configuration of a multidirectional operating switch according to Example 10 of the present invention. Moreover, FIG. 36A is an exploded perspective view illustrating the multidirectional operating switch of FIG. 35; and FIG. 36B is a perspective view illustrating an operating member which is the main component in the configuration. Furthermore, FIG. 37 is a cross-sectional view schematically illustrating a certain operation state of the multidirectional operating switch of the present example.

The multidirectional operating switch of the present example, as compared to the multidirectional operating switch of Example 1, differs in that a central bump portion 60A is provided, instead of the central fixed contact provided on the central portion of the bottom surface of the case, on the central portion of the bottom surface of a case 60 so as to extend upwards out of the hole 38A provided at the center of the dome-shaped movable contact 38, while a supporting dent portion 61B is provided, instead of the conductive member as the central pressing portion of the operating member, at the center of the lower surface of a flange portion 61A of the operating member 61 so as to engage with the above central bump portion 60A. Other than that, the configuration is the same as that of Example 1. Like components are given like reference numerals and may not be further be described below, except where necessary.

Due to the provision of the central bump portion 60A and the supporting dent portion 61B which engage with each other, the multidirectional operating switch of the present example exhibits the switching function only when the operating member 61 is tilted.

In the multidirectional operating switch of the present example having such a configuration, when an end of the knob 42 (the left end in the example illustrated in FIG. 37) is pressed down as indicated by an arrow in FIG. 37, the operating member 61 is tilted about a fulcrum at a top portion 61C on the upper surface of the flange portion 61A. Thus, an inner pressing portion 61D provided on the lower surface of the flange portion 61A presses down and partially inverts the dome-shaped movable contact 38, thereby performing a switching operation while generating a click. At this point, in the configuration of the present example, the central bump portion 60A on the central portion of the bottom surface of the case 60 is engaged with the supporting dent portion 61B on the lower surface of the flange portion 61A of the operating member 61, whereby the physical relationship between the operating member 61 and the case 60 is accurately maintained without being laterally shifted from each other. Thus, a reliable and stable switching operation is achieved with a clear click.

In the description above, the bump portion 60A is provided in the case 60, and the supporting dent portion 61B is provided on the lower surface of the flange portion 61A of the operating member 61. However, similar effects can be obtained also from a configuration in which a bump portion is provided on the lower surface of the flange portion 61A of the operating member 61, and the supporting dent portion 61B is provided in the case 60 so that bump portion and the dent portion 61B engage with each other.

The use of the multidirectional operating switch of the present invention having the features as described above makes it possible to configure a multidirectional operating apparatus having various functions.

Considering the application of the present invention to mobile communication apparatuses, for example, when the multidirectional operating switch of the present invention is attached to a mobile communication apparatus such as a portable phone, a pager, etc., it is possible, by tilting the shaft portion of the operating member, to move the cursor on a display screen such as a liquid crystal display screen, to scroll or search menu items, characters, and the like; and by pushing down the shaft portion, to select a menu item. Moreover, signal transmission can be performed by the push operation.

Moreover, considering the application of the present invention to various remote controls and audio apparatuses, for example, when the multidirectional operating switch of the present invention is attached to various remote controls or an audio apparatus, it is possible to perform alternate switching operations such as the power ON/OFF control or the play/stop operation by repeating the push operation of the shaft portion of the operating member. Moreover, it is also applicable to appropriately pre-assign a set of instructions such as turning, selection, volume control, fast-forward and rewind, to the tilting operation of the shaft portion in the front/rear direction and the tilting operation in the left/right direction (the tilting directions are not limited to the above), respectively, so that a selected one among the set of the pre-assigned operations can be performed by the tilting operations of the shaft portion. Moreover, it is also possible to alter the assignment of the instructions (e.g., to switch between the first and second instruction sets) by the push operation of the shaft portion.

Furthermore, considering the application of the present invention to TV game apparatuses or car navigation apparatuses, when the multidirectional operating switch of the present invention is attached to a TV game apparatus or a car navigation apparatus, it is possible, by tilting the shaft portion, to move the game character or the map on the display according to a tilting direction; and to execute predetermined instructions, such as to alter the magnification of the map or to make the game character jump, by pushing down the shaft portion.

Furthermore, considering the application of the present invention to electronic cameras, when the multidirectional operating switch of the present invention is attached to an electronic camera, it is possible to set the shutter speed, the diaphragm value, or the like, by tilting the shaft portion, thereafter finalizing the setting by pushing down the shaft portion. It is also possible to set the position of the object to be focused within the viewfinder by tilting the shaft portion, and to focus on the object by pushing down the shaft portion, thereafter pressing the shutter by pushing down the shaft portion again within a predetermined period of time.

Furthermore, considering the application of the present invention to computer apparatuses, when the multidirectional operating switch of the present invention is attached to a computer apparatus, it is possible to move the cursor on the display or select a menu item by tilting the shaft portion; and then to finalize the selection or execute the selected instruction by pushing down the shaft portion.

As described above, according to the present invention, in a multidirectional operating switch for performing a tilting operation in multiple directions so as to generate a signal by tilting a shaft portion of an operating member, it is possible to reduce the number of components to be provided therein, and also reduce the outer diameter and thickness of the switch and the height of the entire configuration including the knob. Thus, there is provided a multidirectional operating switch which provides a click even when a switching operation is performed by tilting the operating member and enables a reliable and stable switching operation, while the multidirectional operating switch can be produced at a low cost. When a center fixed contact is further provided at a prescribed position, a signal can be provided when the operating shaft is pushed down, i.e., by a pushing operation. A desirable click is of course provided in the pushing operation.

Moreover, each of signals generated when the shaft portion is tilted toward a direction between adjoining two of the positions where the inner fixed contacts are provided or when a push operation is performed by pushing down the shaft portion may be used as a signal different from signals generated by a tilting operation toward a direction in which one of the inner fixed contacts is provided.

Moreover, when a multidirectional operating apparatus is configured using the multidirectional operating switch of the present invention, it is possible to achieve both the centralized processing of various operations by a simple method and the downsizing of the entire configuration (i.e., making the entire configuration a smaller, thinner and lighter in weight).

The dome-shaped movable contact included in the various multidirectional operating switches of the present invention may be formed of a material with an appropriate spring characteristic which realizes desirable partial inversion such as a spring stainless steel plate, a spring phosphor bronze plate, a beryllium copper plate, or the like. By processing such an appropriate material into a prescribed shape, it becomes possible to provide a click even in the tilting operation.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A multidirectional operating switch, comprising:

a dome-shaped movable contact made of a resilient thin metal plate;

a box-shaped case including, on a bottom surface thereof, an outer fixed contact on which an outer peripheral lower end portion of the dome-shaped movable contact is placed, and a plurality of inner fixed contacts provided inside positions corresponding to the outer peripheral lower end portion of the dome-shaped movable contact so as to be equiangular and equidistant from a center of the dome-shaped movable contact;

a cover including a through hole at a center thereof, the cover being provided so as to cover an upper opening of the case; and an operating member including a shaft portion and a flange portion integrally formed at a lower end of the shaft portion, in which the shaft portion extends upwards out of the through hole of the cover, an upper surface of the flange portion is in contact with an inner surface of the cover, a periphery of the operating member is fitted to and supported by an inner wall of the case so that the operating member is not rotatable but is tiltable and movable vertically, first pressing portions are provided respectively at positions on a lower surface of the operating member corresponding to the plurality of inner fixed contacts, and the plurality of first pressing portions are in contact with the dome-shaped movable contact, wherein the switch performs a tilting operation in multiple directions so as to generate a signal by tilting the shaft portion of the operating member.

2. A multidirectional operating switch according to claim 1, wherein a click is generated in the tilting operation of the operating member.

3. A multidirectional operating switch according to claim 1, wherein:

the case further includes a central fixed contact provided at a position on said bottom surface of the case which corresponds to the center of the dome-shaped movable contact; and the operating member further includes a second pressing portion provided at a position on the lower surface of the operating member which corresponds to the center of the dome-shaped movable contact.

4. A multidirectional operating switch according to claim 3, wherein a height of each of the plurality of first pressing portions is less than a height of the second pressing portion.

5. A multidirectional operating switch according to claim 3, wherein:

a hole is provided at the center of the dome-shaped movable contact;

the central fixed contact has a diameter smaller than a diameter of the hole of the dome-shaped movable contact; and a height of each of the plurality of inner fixed contacts is less than a height of the central fixed contact.

6. A multidirectional operating switch according to claim 5, wherein:

the first pressing portion is a polygonal ring-shaped pressing portion or a circular ring-shaped pressing portion which includes, at a center thereof, a dent portion larger than the hole of the dome-shaped movable contact; and the second pressing portion is formed, in the dent portion of the first pressing portion, of a conductive member approximately as tall as the first pressing portion.

7. A multidirectional operating switch according to claim 3, wherein the second pressing portion is formed of a resilient conductive member.

8. A multidirectional operating switch according to claim 3, wherein the plurality of first pressing portions and the second pressing portion are integrally formed of a conductive member.

9. A multidirectional operating switch according to claim 1, wherein:

a hole is provided at the center of the dome-shaped movable contact;

the case further includes a central bump portion provided at a position on said bottom surface of the case which corresponds to the center of the dome-shaped movable contact, the central bump portion having a diameter smaller than a diameter of the hole of the dome-shaped movable contact and extending taller than the outer fixed contact; and the operating member further includes a dent portion provided at a center of a lower surface of the operating member so as to engage with the central bump portion of the case.

10. A multidirectional operating switch according to claim 9, wherein the first pressing portion is a polygonal ring-shaped pressing portion or a circular ring-shaped pressing portion which includes, at a center thereof, a dent portion larger than the hole of the dome-shaped movable contact.

11. A multidirectional operating switch according to claim 1, wherein the plurality of first pressing portions are each formed of a resilient member.

12. A multidirectional operating switch according to claim 1, further comprising a conductive resilient member provided between the outer fixed contact and the dome-shaped movable contact, the conductive resilient member having a repulsive force smaller than an inversion force of the dome-shaped movable contact.

13. A multidirectional operating switch according to claim 1, further comprising a resilient member provided between the inner surface of the cover and the upper surface of the flange of the operating member.

14. A multidirectional operating switch according to claim 1, wherein the dome-shaped movable contact includes an outer peripheral portion in a frustum shape and a portion inside the outer peripheral portion in a substantially spherical shape with a central portion thereof being raised slightly, and the frustum shape and the substantially spherical shape are connected to each other at a boundary therebetween by a smooth curve.

15. A multidirectional operating switch according to claim 14, wherein the dome-shaped movable contact is formed by a drawing process of said resilient metal thin plate.

16. A multidirectional operating switch according to claim 14, wherein:

an angle formed between a slope of the frustum shape of the dome-shaped movable contact and a bottom surface thereof is about 25° to about 35°;

a ratio of a height of the frustum shape of the dome-shaped movable contact with respect to a total height of the dome-shaped movable contact is about 70% to about 95%; and a ratio of a diameter of the first pressing portion of the operating member with respect to an outer diameter of the dome-shaped movable contact is about 40% to about 60%.

17. A multidirectional operating switch according to claim 1, wherein:

the operating member includes a hole running down from an upper end surface of the shaft portion;

an operating knob having a leg portion which is coupled to the operating member by inserting the leg portion into the hole of the operating member; and a depth of the hole is greater than a distance by which the shaft portion extends out of the cover.

18. A multidirectional operating switch according to claim 17, wherein:

a dent portion or a protruding portion is provided on an inner wall surface of the hole of the operating member;

a protruding portion or a dent portion is provided on an outer peripheral surface of the leg portion of the operating knob so as to engage with the dent portion or the protruding portion of the operating member.

19. A multidirectional operating switch according to claim 17, wherein each of the hole of the operating member and the leg portion of the operating knob has a diameter at an upper portion thereof larger than a diameter at a lower portion thereof.

20. A multidirectional operating apparatus including a multidirectional operating switch according to claim 1, wherein:

at least diagonally-located two of the plurality of inner fixed contacts are both turned ON when the shaft portion of the operating member of the multidirectional operating switch is pushed down vertically; and the apparatus comprises a processing section which processes a signal which is generated when two of the plurality of inner fixed contacts are both turned ON as a signal different from a signal which is generated when only one of the inner fixed contacts is turned ON.

21. A multidirectional operating apparatus according to claim 20, wherein:

when the shaft portion of the operating member of the multidirectional operating switch is tilted toward a direction between adjoining two of the plurality of inner fixed contacts, the adjoining two of the inner fixed contacts are both turned ON; and the processing section processes a signal which is generated when the adjoining two of the inner fixed contacts are both turned ON as a signal different from the signal which is generated when only one of the inner fixed contacts is turned ON.

22. A multidirectional operating apparatus including a multidirectional operating switch according to claim 1, wherein:

when the shaft portion of the operating member of the multidirectional operating switch is tilted toward a direction between adjoining two of the plurality of inner fixed contacts, the adjoining two of the inner fixed contacts are both turned ON; and the apparatus comprises a processing section which processes a signal which is generated when the adjoining two of the inner fixed contacts are both turned ON as a signal different from the signal which is generated when only one of the inner fixed contacts is turned ON.

23. A multidirectional operating apparatus according to claim 22, wherein:

the case further includes a central fixed contact provided at a position on a bottom surface of the case which corresponds to a center of the dome-shaped movable contact; and the operating member further includes a second pressing portion provided at a position on a lower surface of the operating member which corresponds to the center of the dome-shaped movable contact.

24. A multidirectional operating apparatus according to claim 22, wherein:

the apparatus detects a signal generated in the tilting operation of the shaft portion of the operating member of the multidirectional operating switch, and selects an item from a plurality of displayed items; and the apparatus detects a signal generated in a push operation of the shaft portion, and confirms the selection of the item.

25. A multidirectional operating apparatus according to claim 22, wherein:

the apparatus detects a signal generated in the tilting operation of the shaft portion of the operating member of the multidirectional operating switch, selects a preassigned vector direction signal of a plurality of vector signals, and moves a displayed object in the selected vector direction; and the apparatus detects a signal generated in a push operation of the shaft portion, and executes a preassigned instruction for the moved object.

26. A multidirectional operating apparatus according to claim 22, wherein the apparatus detects a signal generated by performing a plurality of push operations of the shaft portion of the operating member of the multidirectional operating switch within a predetermined period of time, and sequentially executes a plurality of instruction signals which are predesigned for the detected signals.

27. A multidirectional operating apparatus according to claim 22, wherein the apparatus detects a signal generated in a push operation of the shaft portion of the operating member of the multidirectional operating switch, and based on the detected signal, alters instructions which are respectively assigned for tilting directions of the shaft portion in the tilting operation of the shaft portion, in accordance with a predetermined order.

28. A multidirectional operating apparatus according to claim 22, wherein an up-down adjustment of functions assigned to the tilting directions is performed by tilting the shaft portion toward a predetermined tilting direction during the tilting operation of the shaft portion of the operating member of the multidirectional operating switch.

* * * * *